US010265608B2

(12) United States Patent
Abraham

(10) Patent No.: US 10,265,608 B2
(45) Date of Patent: Apr. 23, 2019

(54) ASSEMBLY AND METHOD FOR FRAME SIDE MATCHING GAME PLAY

(71) Applicant: Albert S. Abraham, Wichita, KS (US)

(72) Inventor: Albert S. Abraham, Wichita, KS (US)

( * ) Notice: Subject to any disclaimer, the term of this patent is extended or adjusted under 35 U.S.C. 154(b) by 0 days.

(21) Appl. No.: 15/878,105

(22) Filed: Jan. 23, 2018

(65) Prior Publication Data

US 2018/0147481 A1 May 31, 2018

Related U.S. Application Data

(63) Continuation-in-part of application No. 15/357,884, filed on Nov. 21, 2016, now abandoned, which is a continuation-in-part of application No. 14/802,638, filed on Jul. 17, 2015, now abandoned.

(51) Int. Cl.

| | |
|---|---|
| ***A63F 1/02*** | (2006.01) |
| ***A63F 1/04*** | (2006.01) |
| ***A63F 9/06*** | (2006.01) |
| ***A63F 9/20*** | (2006.01) |

(52) U.S. Cl.

CPC ..... *A63F 1/02* (2013.01); *A63F 1/04* (2013.01); *A63F 9/0669* (2013.01); *A63F 9/20* (2013.01); *A63F 2001/0483* (2013.01); *A63F 2250/128* (2013.01); *A63F 2250/13* (2013.01)

(58) Field of Classification Search

CPC ..... A63F 1/02; A63F 1/04

See application file for complete search history.

(56) References Cited

U.S. PATENT DOCUMENTS

| | | | | |
|---|---|---|---|---|
| 1,320,628 A | | 11/1919 | Lowman | |
| 1,450,874 A | * | 4/1923 | Stromee | A63F 9/20 273/292 |
| 1,666,448 A | | 4/1928 | Hardenstein | |
| 2,232,046 A | | 2/1941 | Bigman | |
| 3,547,444 A | | 12/1970 | Williams | |
| 4,236,720 A | | 12/1980 | Belony | |
| 4,299,391 A | | 11/1981 | Silver | |
| 4,659,085 A | | 4/1987 | DeVries | |
| 4,715,605 A | | 12/1987 | Fritzman | |
| 4,778,188 A | | 10/1988 | Brooker | |
| 4,867,455 A | | 9/1989 | Fritzman | |

(Continued)

FOREIGN PATENT DOCUMENTS

WO WO2012077094 A1 6/2012

OTHER PUBLICATIONS

Travis, Kacie (www.teacherspayteacheres.com/store/kacie-travis) Integer Square Dance Match Game.

*Primary Examiner* — Michael D Dennis

(74) *Attorney, Agent, or Firm* — Kenneth H. Jack; Davis & Jack, L.L.C.

(57) ABSTRACT

A game play assembly incorporating 24 substantially square frames, each substantially square frame having a quadruple of zones; and incorporating 96 objects wherein a first third of the 96 objects are of a first type, wherein a second third of the 96 objects are of a second type, wherein the remainder of the 96 objects are of a third type, wherein the 96 objects are divided in 24 four element rotational series of objects, wherein each four element rotational series of objects is supported upon and aligned with one of the quadruples of zones, and wherein each four element rotational series of objects is different from each other four element rotational series of objects.

1 Claim, 20 Drawing Sheets

(56) References Cited

U.S. PATENT DOCUMENTS

| | | | | |
|---|---|---|---|---|
| 660,004 | A | 10/1990 | Christie | |
| 5,803,461 | A | 9/1998 | Pavlovic | |
| 5,992,854 | A | 11/1999 | Flory et al. | |
| 6,027,117 | A | 2/2000 | Goldberg | |
| 6,062,566 | A | 5/2000 | Lemons | |
| 6,102,401 | A | 8/2000 | Segman et al. | |
| 6,755,419 | B2 | 6/2004 | Markus | |
| 6,971,649 | B2 | 12/2005 | Richardson et al. | |
| 2004/0188937 | A1 | 9/2004 | Young | |
| 2013/0234388 | A1* | 9/2013 | Dale | A63F 9/10 273/156 |
| 2015/0321079 | A1 | 11/2015 | Abraham | |
| 2017/0065876 | A1 | 3/2017 | Abraham | |

* cited by examiner

ASSEMBLY AND METHOD FOR FRAME SIDE MATCHING GAME PLAY

REFERENCE TO PREVIOUSLY FILED PATENT APPLICATIONS

References are made to U.S. patent application Ser. Nos. 14/802,638 and 15/357,884 which are respectively entitled "Playing Cards Deck and Method of Play" and "Assembly and Method for Frame Side Matching Game Play", and which were respectively filed Jul. 17, 2015, and Nov. 21, 2016. The instant application constitutes a continuation in part of said Ser. No. 15/357,884 application, and said Ser. No. 15/357,884 application constituted a continuation in part of said Ser. No. 14/802,638 application. The inventor of and applicant of said Ser. Nos. 14/802,638 and 15/357,884 applications and the instant application are the same, and the instant application is filed prior to any issuance or abandonment of said Ser. No. 15/357,884, which was filed prior to any issuance of abandonment of said Ser. No. 14/802,638 application. The benefits of and priority rights from said Ser. No. 14/802,638 application's Jul. 17, 2015 filing date, and of and from said Ser. No. 15/357,884 application's Nov. 21, 2016 priority date, are hereby claimed.

FIELD OF THE INVENTION

This invention relates to frame sets which are playable in a sides matching fashion upon a flat playing surface.

BACKGROUND OF THE INVENTION

Game play frame sets may comprise a series of geometrically configured frames which support arrays of objects which are capable of visual and/or tactile perception. Such frame sets commonly allow contestants in a game utilizing the frame set to strategically deduce or infer probabilities relating to the identity of frames not seen or not played, such deductions and inferences being founded upon the contestants' view of an incomplete subset of the game's series of frames, and via the contestant's knowledge and understanding of the identity and character of all of the frames among games set of frames.

The instant inventive frame set, in an improved and enhanced fashion, facilitates a game contestant's frame identity knowledge by utilizing quadrant zones defined upon the frame component as base support for object quadruples arrayed as rotational series of distinct objects. The invention's rotational series of distinct objects allow each of the set's frames to support a unique array of objects, where the number of frames among the set is specified by the formula $(n^4+n^2+2n)/4$, with "n" representing a small number of unique object types such as 3 object types, 4 object types, or 5 object types.

The instant invention's utilization of the $(n^4+n^2+2n)/4$ rotational object series defining formula advantageously allows game contestants utilizing the inventive frame and playing the inventive game based thereon to memorize and/or conceptually understand the identity of each of the frames among the set. The instant invention's association of unique object series with the frames' quadrant zones further advantageously facilitates a frame edge matching mode of game play upon a flat play surface, such game play utilizing deduction and inference strategies that are facilitated by the game's rotational object series.

BRIEF SUMMARY OF THE INVENTION

The frame set of the instant invention preferably comprises a plurality of four sided or four edged frames. In the preferred embodiment, each frame among the plurality of four sided frames is composed of a rigid or semi-rigid substrate. Suitable substrate materials comprise wood, flexible stratifications of pulped wood, and plastic.

Further components of the instant inventive frame set comprise a first plurality, a second plurality, and at least a third plurality of objects, each object in each such plurality of objects being substantially the same as each other object in such plurality and being different from the other pluralities' objects. Accordingly, the at least three pluralities of objects are representative of three object types.

The invention's objects are preferably fastened, attached, or fixedly secured upon the frames. In a suitable embodiment, the first plurality's objects comprise null, vacant, or blank objects. Also suitably, the first objects of the instant invention may alternatively comprise a distinct physically existing object type.

The invention's second objects are preferably physically existent and may suitably comprise a deposition of ink or paint having a peripheral edge which is configured for silhouetting an arrow.

The invention's at least third objects may be similar to the second objects with a further configuration for silhouetting notches or crosses upon the silhouetted arrows.

Suitably, the invention's first, second, and at least third object types may comprise other items such as variously colored depositions of paint or ink, other silhouetted shapes, bold relief protrusions, indentations, and various other physical objects. A necessary characteristic of the instant invention's object types is that they be distinguishable from each other through visual appearance and/or tactility.

In a suitable alternative structure of the instant invention, the frame components, along with their objects, may be virtual or digitally generated, with individual frames and objects supported thereon appearing upon digital visual output device.

In a preferred embodiment of the instant inventive frame set, each frame is substantially square, and the invention's first, second, and third object types are displayed upon the frames in four element series or quadruples arrayed in alignments with quadruples of isosceles triangular zones which are circumferentially bounded by the frame's corner-to-corner diagonals. In the preferred embodiment, each frame's object series is rotational and is unique with respect to that of each frame's object series.

Where the inventive frame set supports objects selected from multiple unique object types, the formula $(n^4+n^2+2n)/4$ defines the number of frames which are included in the frame set. In such formula, the variable "n" may represent as few as three unique object types. Where "n" equals 3, $(n^4+n^2+2n)/4$ equals 24, which is a preferred number of frames incorporated in the inventive frame set.

Where the inventive frame set alternatively utilizes objects selected from four unique object types (e.g., utilizing a null object, a penny object, a penny pair object, and a penny triple object), "n" equals 4 and application of the above formula requires a frame set having 70 members for support of 70 unique rotational object series. Where the 70 member frame set supports such four object types series, 24 of the frames of the resultant 70 frame set are necessarily identical to the smaller frame set which is defined upon utilization of only three of such four unique object types. A five object type frame set results in a large set of 165 frames, and such large frame set comprises both the above described set of 24 frames, and the above described set of 70 frames.

In a preferred mode of game play utilizing the inventive frame set, each of two or more game playing contestants may receive two or more frames from the 24 frame set. Upon receiving their frames, each contestant is immediately able to deduce and infer probabilities relating to the identity of frames distributed to the other contestants, and relating to the identity of any frames yet to be given to any contestant. The contestants' ability to make such deductions and inferences is facilitated by the frame set's $(n^4+n^2+2n)/4$ formula based rotational series of unique objects, such formula enhancing the contestants' conceptual understanding of the frames' individual configurations. Such conceptual understanding assists in the making of strategic choices during game play.

In a preferred mode of play, the game playing contestants play frames in a rotating or alternating sequence, the players laying the frames upon a flat table surface. Following a frame play, a contestant may draw a replacement frame from a pool of those frames which have yet to be distributed to or drawn by any player. In each successive frame play, the contestant playing the frame may match at least a first frame side with a side of a previously played frame, each frame play being directed to an objective of completing square matrixes of frames. In a preferred mode of game play, contestants completing square matrixes of frames are awarded positive points. At an end of play, the contestant accumulating the most awarded points is declared a winner.

Accordingly, objects of the instant invention include the provision of a frame set and play method which incorporate structures, as described above, and which prescribes game play steps, as described above, such structural provision and game play steps being arranged, configured, and ordered for the achievement of the benefits, functions, and advantages described above.

Other and further objects, benefits, and advantages of the instant invention will become known to those skilled in the art upon review of the Detailed Description which follows, and upon review of the appended drawings.

DETAILED DESCRIPTION OF PREFERRED EMBODIMENTS AND OF A PREFERRED MODE OF GAME PLAY

Figure 12:
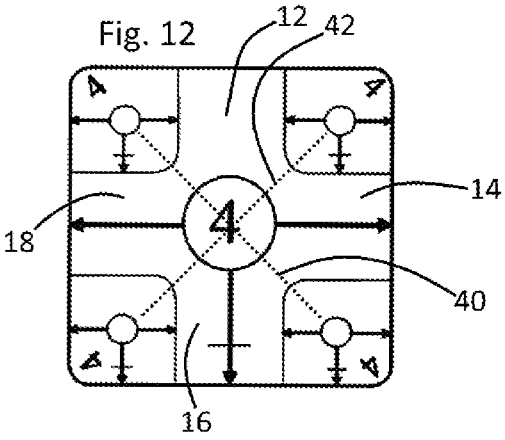
Figure 25:
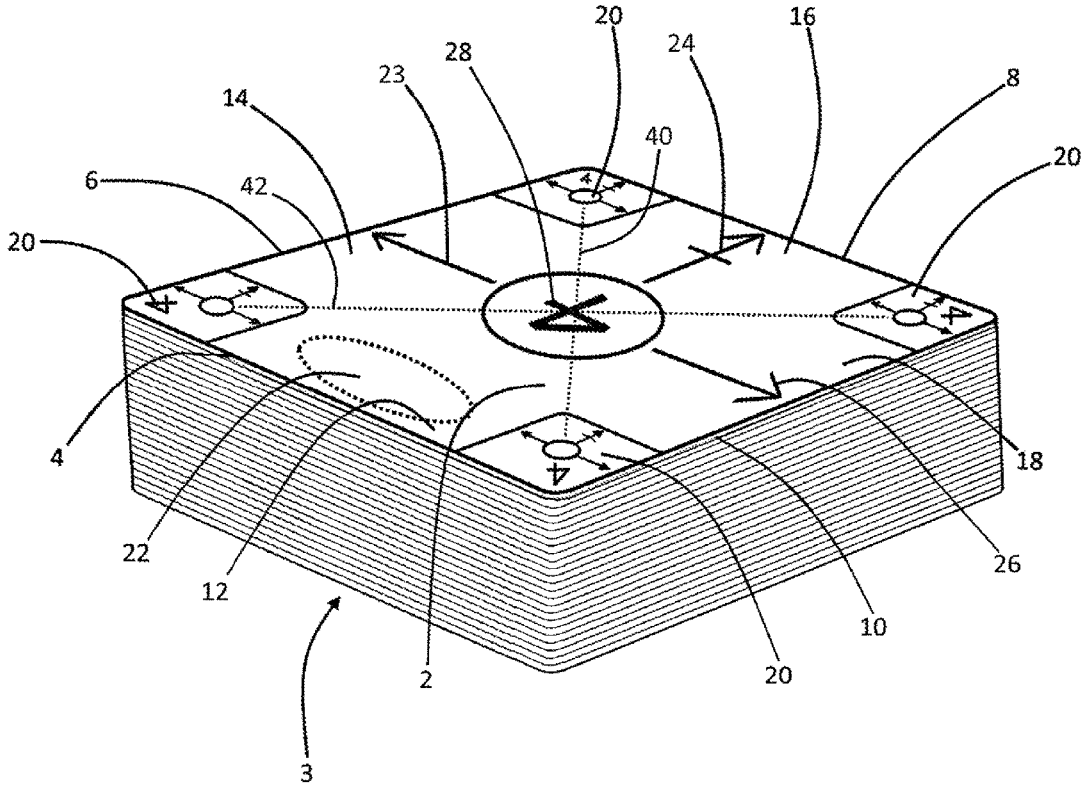
FIG. 25 is a perspective and stacked view of the frames of FIGS. 1-24, the topmost frame of the stack corresponding with the frame of FIG. 12.

Referring now to the drawings and in particular simultaneously to Drawing FIGS. 12 and 25, the frame structure of FIG. 12 is, for the sake of example, shown at the top of a stacked configuration of the instant inventive frame set, such stack of frames being referred to generally by Reference Arrow 3.

The FIG. 12 frame is preferably substantially square, and has an upper side 2 or surface. The FIG. 12 frame is suitably composed of durable thin material, and has four orthogonal edges 4, 6, 8, and 10. As shown in FIGS. 28-37, the invention's frame components may alternatively be relatively thick and rigid.

Isosceles triangular zones or quadrants 12, 14, 16, and 18 are positioned at the upper side 2 of the FIG. 12 frame, and such zones are respectively radially outwardly bounded by the frame edges 4, 6, 8, and 10, and are circumferentially or rotationally bounded by diagonals 40 and 42. Referring further simultaneously to FIGS. 1-11 and 13-24, each of the depicted four edged frames may suitably be configured substantially identically with the FIG. 12 frame.

Referring simultaneously to FIGS. 12 and 25, a first object 22, a second object 23, a third object 24, and a fourth object 26 are depicted. The first object 22 is designated by a dashed line oval signifying a blank or null space which is supported by the FIG. 12 frame at a fixed position within zone 12. A physical object capable of being visually or tactilely perceived by a game contestant (e.g., referring to FIG. 35, a triangular protrusion 108) may be suitably substituted for such null object 22.

A clockwise zone-to-zone progression from the null object 22 initially arrives at an object 23 supported within zone 14. Such object 23 may comprise, as depicted, a deposition of paint or ink having a peripheral border or edge configured for silhouetting an arrow, such object is secured by the FIG. 12 frame within zone 14. Continuation of such clockwise progression next meets a crossed arrow object 24 which is supported by the FIG. 12 frame within zone 16. Thereafter, the clockwise progression meets a fourth object which is another arrow 26 in zone 18, and the progression then cyclically returns to the null object 22 in zone 12.

Figure 28:
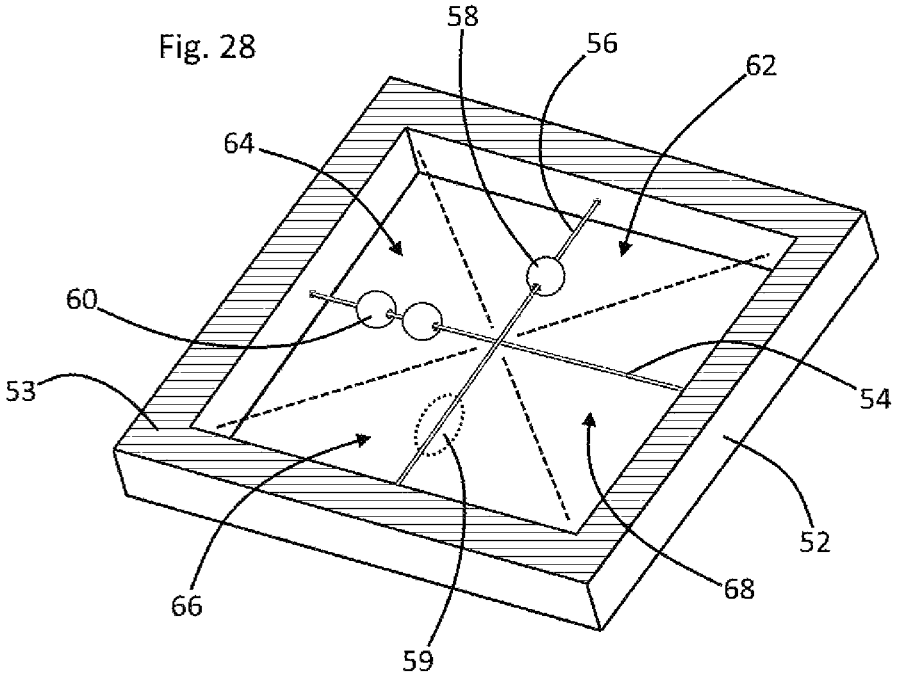
FIG. 28 presents an alternative frame and rotational objects series combination.

The null space object 22, the arrow objects 23 and 26, and the notched arrow object 24 which are positioned and supported upon the FIG. 12 frame are intended as being representative of other suitably substituted first, second, third, and fourth objects such as ink depositions silhouetting numbers, ink depositions silhouetting letters, ink depositions silhouetting geometric shapes, ink depositions silhouetting various articles or things, bold relief protrusions of varying shapes, indentations of varying shapes and various physical articles and things. For example, as is shown in FIG. 28, the invention's three object types may comprise a bead 58, a bead pair 60, and a null object 59. Means for supporting such objects upon frame 52 and within the frame's quadruple of quadrants or isosceles triangular zones 62, 64, 66, and 58 may suitably comprise wires 56 and 58. Hatching 53 upon the upwardly oriented surface of the frame 52 is representative of a color or texture differential which allows game contestants to determine the frame's upper side. In the structure of FIG. 28, objects of the null type are supported by the frame 52 within triangular zones 66 and 68, an object of the bead type is supported within zone 62, and an object of the bead pair type is supported within zone 64, each of such three object types being distinctly different from each other.

Figure 29:
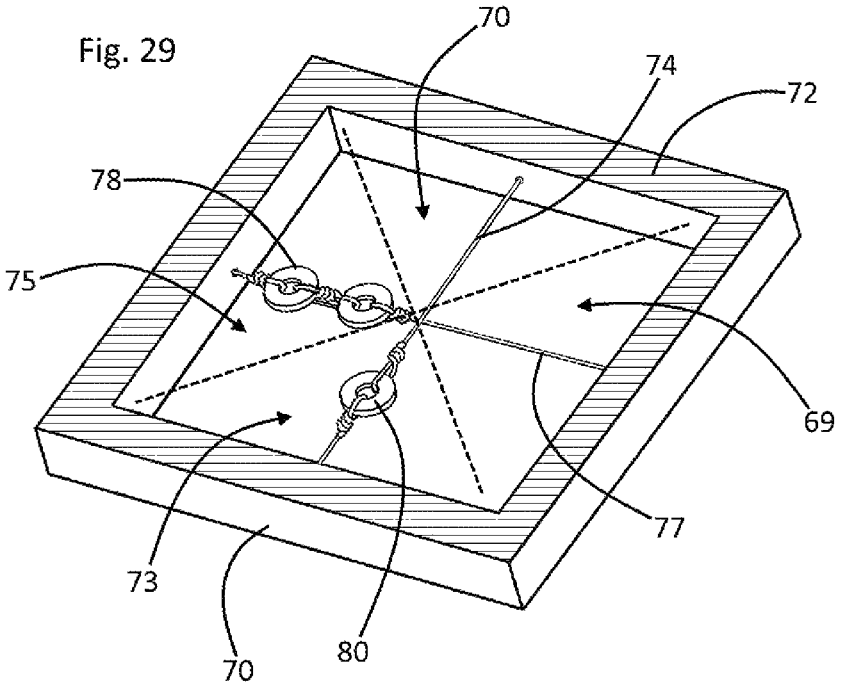
FIG. 29 presents a further alternative frame and rotational object series combination.

In the alternatively configured frame 70 (having upper side 72) of FIG. 29, wires 74 and 77 support null objects within triangular zones 69 and 71, while supporting a washer type object 80 within zone 73 and a washer pair type object 70 within zone 75.

Figure 30:
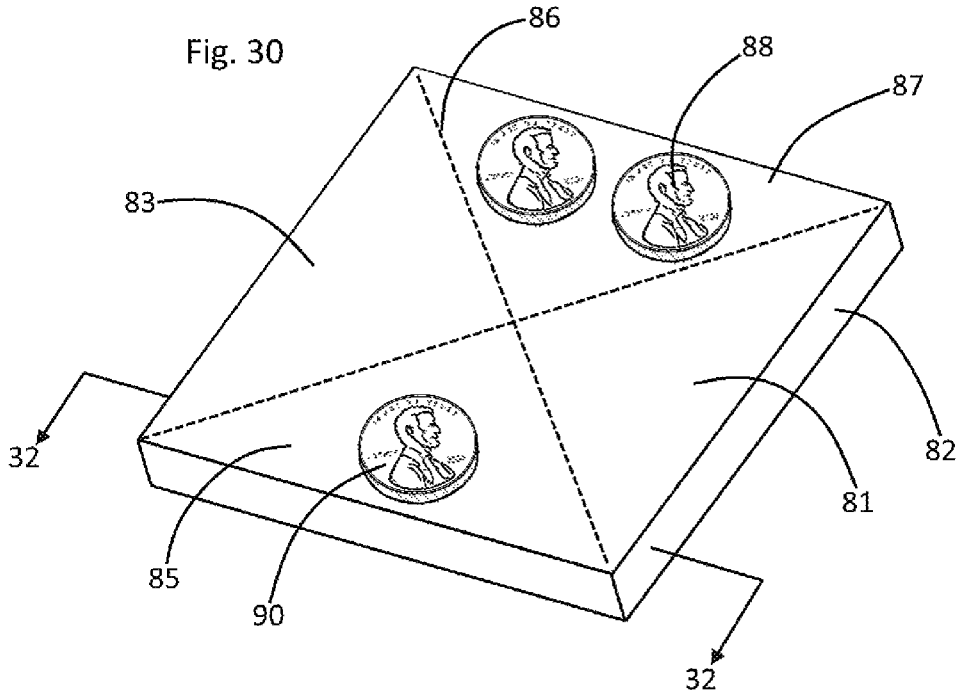
FIG. 30 presents a further alternative frame and rotational object series combination.
Figure 32:
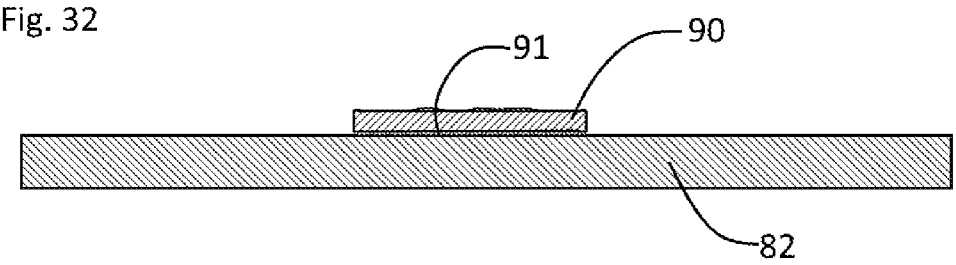
FIG. 32 is a sectional view as indicated in FIG. 30.

In the further alternative frame of 82 of FIG. 30, null type objects are supported within triangular zones 81 and 83, while a penny type object 90 is supported within zone 85 and a penny pair type object 88 is supported within zone 87. Referring further to FIG. 32, in lieu of the wires 54, 56, 74, and 77 of the FIGS. 28 and 29 frames, glue 91 is utilized by the frame 82 to fixedly support and position the penny type and penny pair objects within zones 85 and 87.

Figure 31:
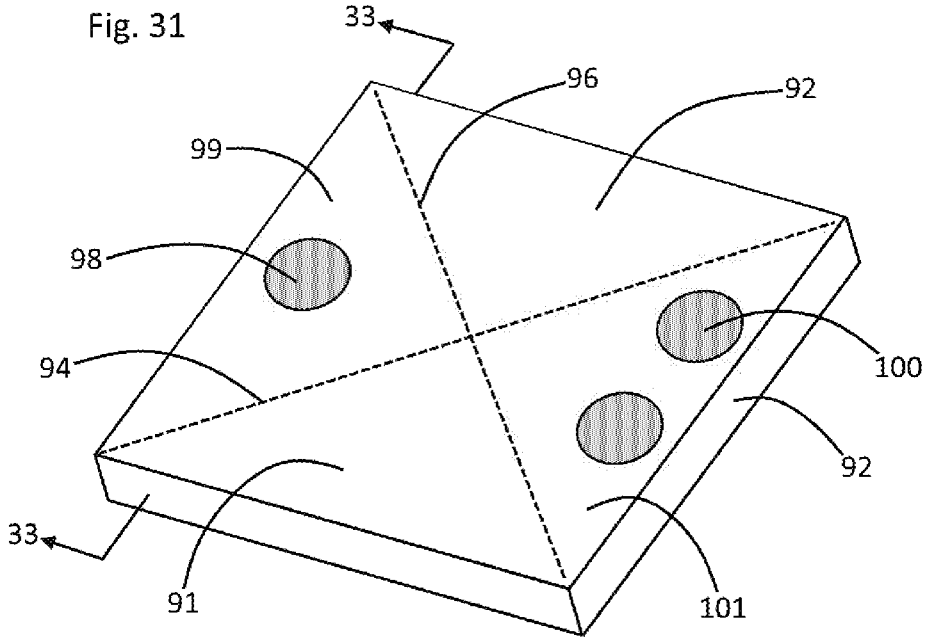
FIG. 31 presents a further alternative frame and object configuration.
Figure 33:
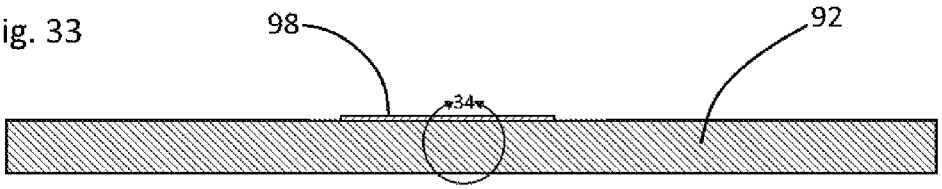
FIG. 33 is a sectional view as indicated in FIG. 31.
Figure 34:
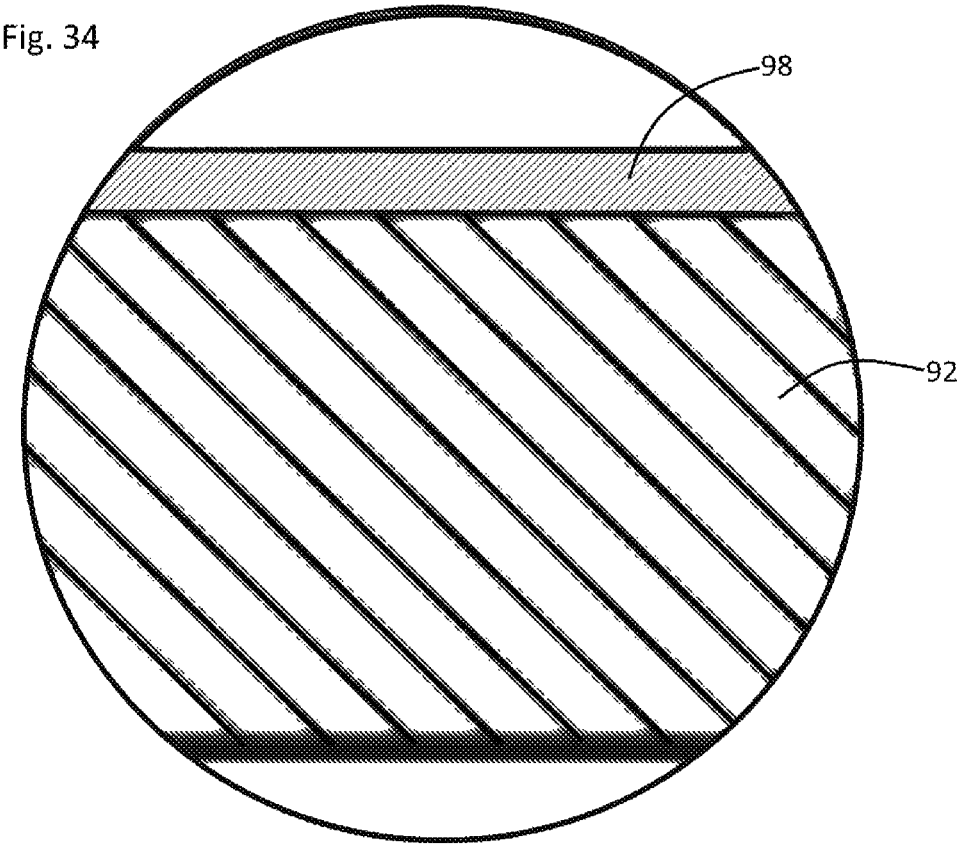
FIG. 34 is a partial magnified view of the structure of FIG. 33, as indicated in FIG. 33.

In a further alternative frame 92 of FIGS. 31, 33, and 34, null type objects are supported within triangular zones 91 and 92, while a dot type object 98 is supported within zone 99, and a dot pair type object 100 is supported within zone 101. The dot object 98 and the dot pair object 100 may comprise a disposition of paint, a disposition of ink, or a decal, or an applique, and the frame 92 may utilize the adhesive characters of such objects as its means for holding and fixedly positioning such objects.

Figure 35:
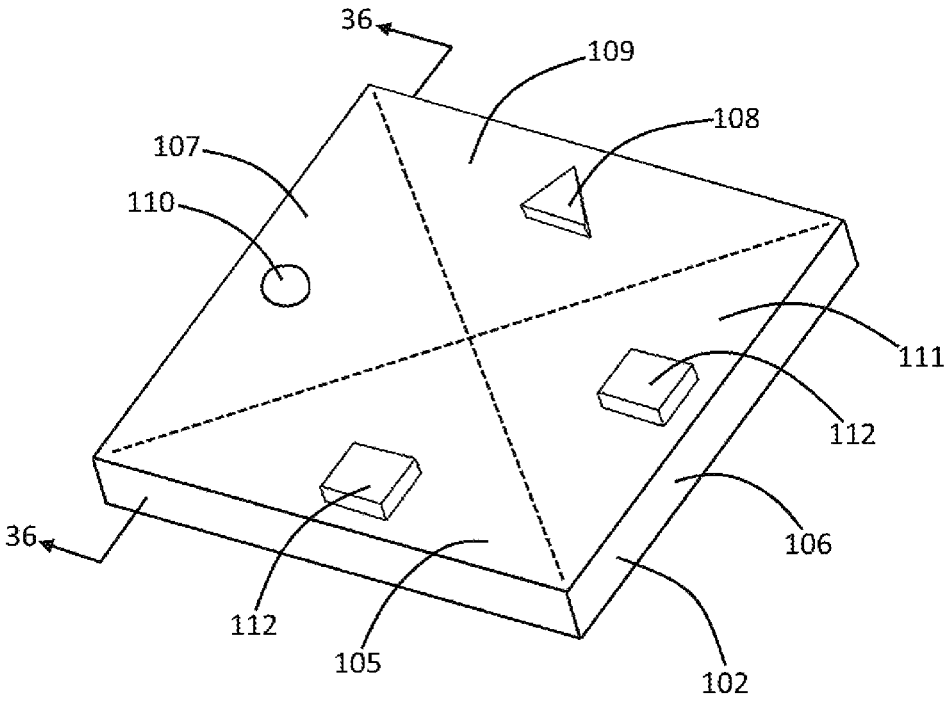
FIG. 35 presents a further alternative frame and rotational object series combination.
Figure 36:
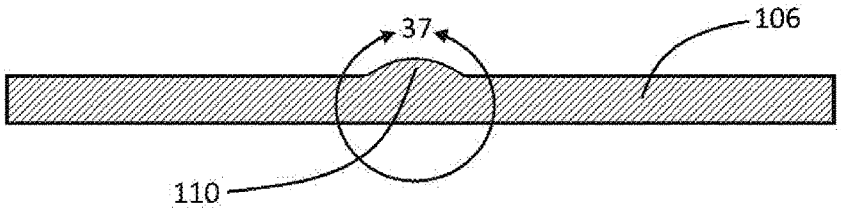
FIG. 36 is a sectional view of the structure of FIG. 35, as indicated in FIG. 35.
Figure 37:
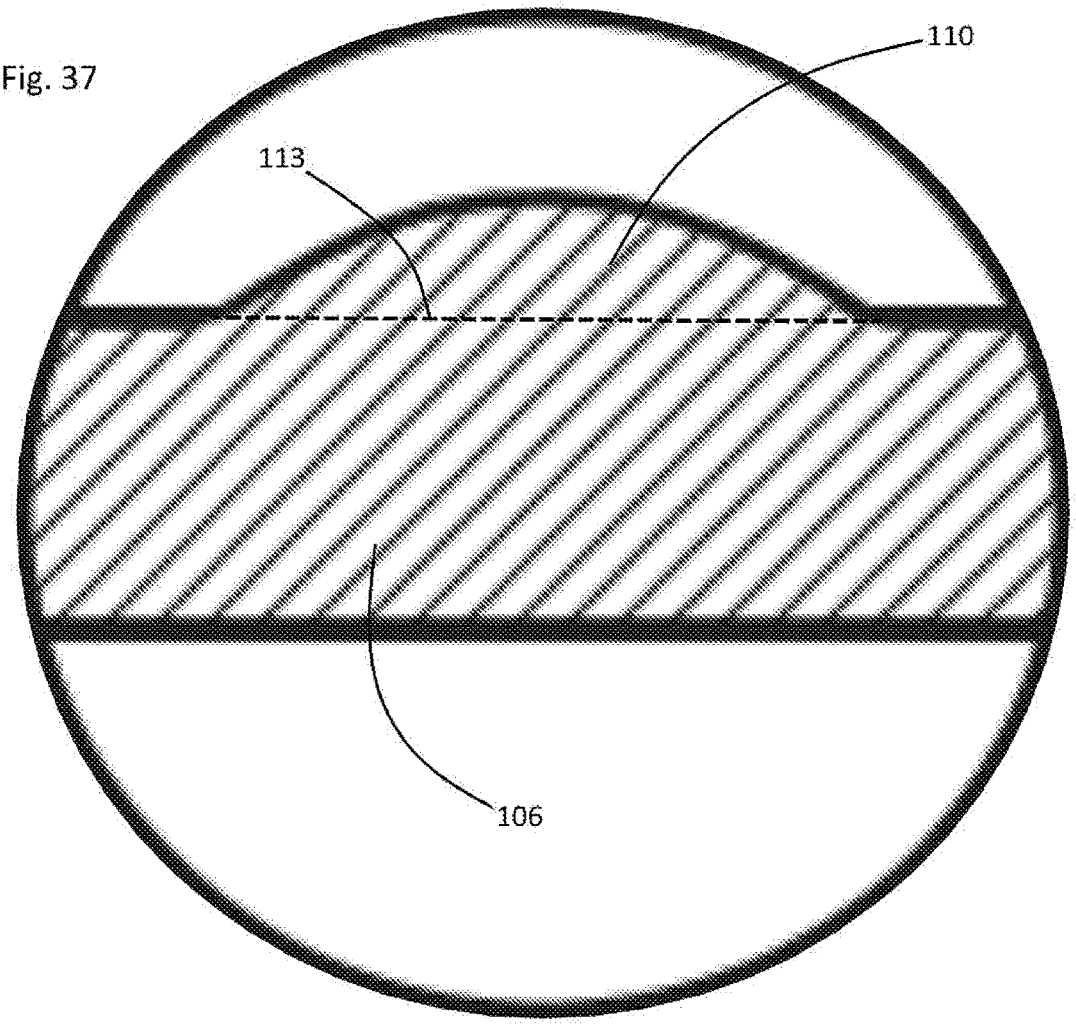
FIG. 37 is a partial magnified view of the structure of FIG. 36, as indicated in FIG. 36.

In the further alternative frame 106 of FIGS. 35-37, a first triangular bold relief protrusion type object 108 is supported within triangular zone 109, while a circular bold relief protrusion type object 110 is supported within zone 107. A pair of square bold relief protrusion type objects 112 are supported within zones 105 and 111. As indicated in FIG. 37, the frame 106 utilizes wholly formed joints such as joint 113 as its means for securing and positioning its objects.

The objects and object types 24, 26, 58, 60, 78, 80, 88, 90, 98, 100, 108, 110, 112, and null objects 22 and 59 described above are considered to be representative of other object types which are amenable to being supported and positioned by a frame and which are easily discerned as differing from other object types through a game contestant's use of his or her visual and/or tactile senses.

Referring simultaneously to FIGS. 1-25, 96 objects are shown attached to the 24 frames, a first one-third or 32 of the 96 objects being renditions of a first object type (i.e., null object 22), a second one-third or 32 being renditions of a second object (i.e., arrow shaped ink deposition 23), and the remaining 32 being renditions of a third object type (i.e., notched arrow shaped ink deposition 24). Referring in particular to FIGS. 12 and 25, the first object 22 type, being a blank, null, or arrow-less space, may be advantageously assigned or ascribed a numerical value of zero. The other two object types supported upon the frame (i.e., plain arrow 23 and notched arrow 24) are correspondingly advantageously assigned values of one and two. Suitably, other numeric values may be assigned to the frames' object types. Given the respective assignments of the preferred 0, 1, and 2 numerical values to the object types 22, 23, and 24, a cumulative total of the object type values appearing on FIG. 12 frame equals 4. To reflect such cumulative object type total, a matching integer indicia 28 comprising the number 4 may be advantageously centrally printed upon the FIG. 12 frame. Referring further to FIGS. 1-11 and 13-24, each frame's central integer indicia preferably signifies the sum of the frame's object values.

Referring further to FIGS. 12 and 25, it may be seen that corner indicia 20 frame depicts at the frame's corners both the frame's central integer indicia 28 and the frame's array of four objects. Referring further to Drawing FIG. 26, the presence of such corner indicia 20 upon the frames allows subsets of the frames to be held by a game playing contestant in a fan 30. In the fan 30, the values associated with each frame held by the contestant are conveniently displayed at the frames' exposed corners. In any rotational orientation of the frames of the fan 30, corners and corner indicia 20 are conveniently upwardly exposed, allowing the game playing contestant to assess the content of the frames within the fan 30 without the necessity of individually moving and repositioning the frames.

Figure 1:
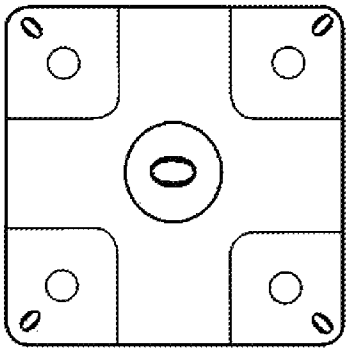
FIGS. 1-24 present images of upper sides of frames included within the instant inventive frame set.
Figure 2:
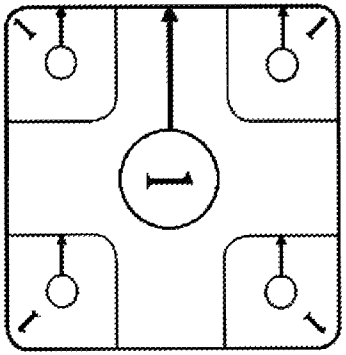
Figure 3:
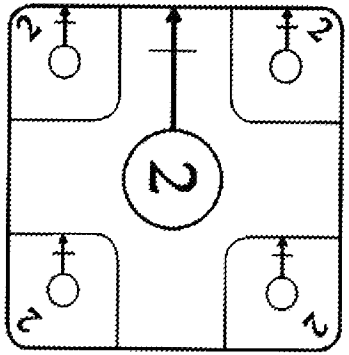
Figure 4:
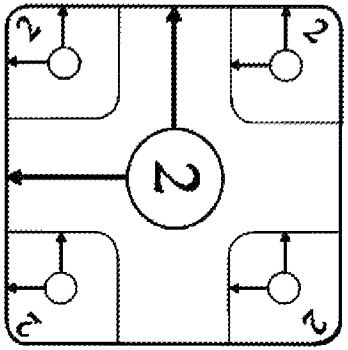
Figure 5:
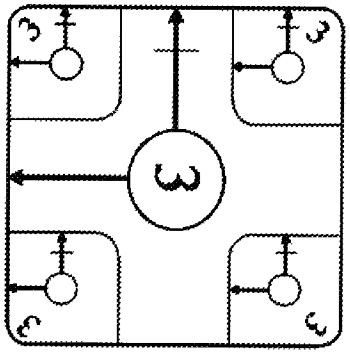
Figure 6:
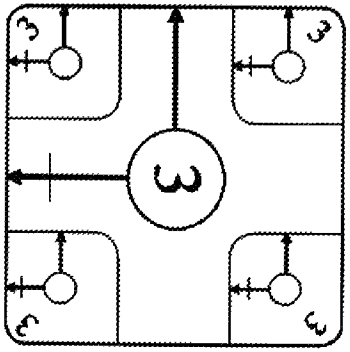
Figure 7:
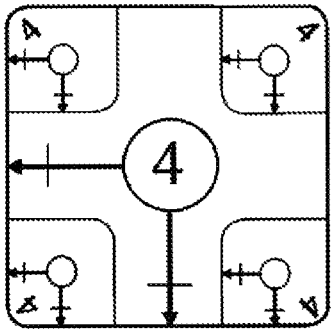
Figure 8:
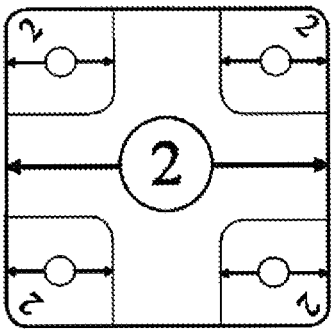
Figure 9:
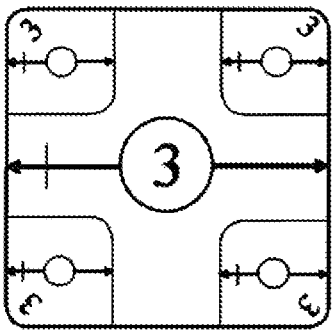
Figure 10:
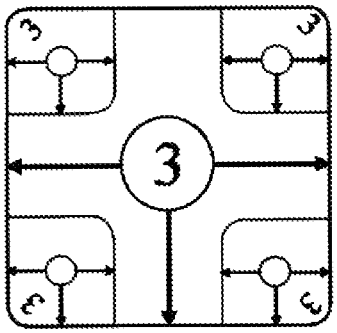
Figure 11:
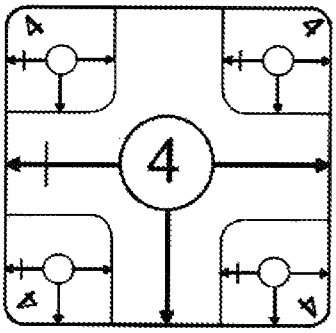
Figure 13:
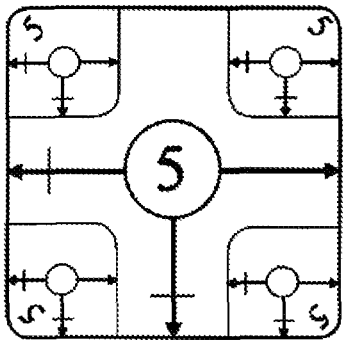
Figure 14:
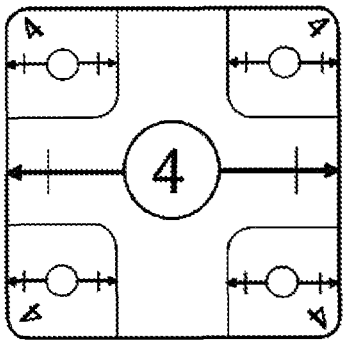
Figure 15:
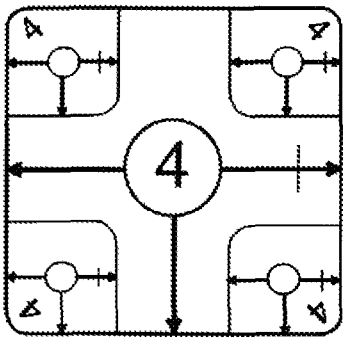
Figure 16:
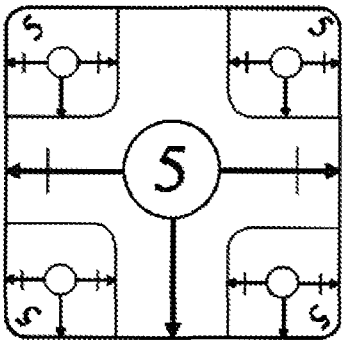
Figure 17:
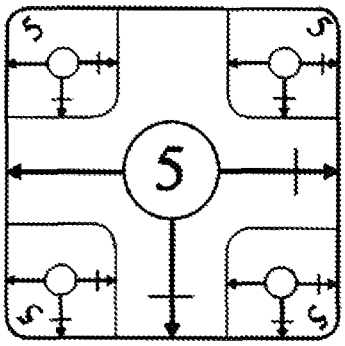
Figure 18:
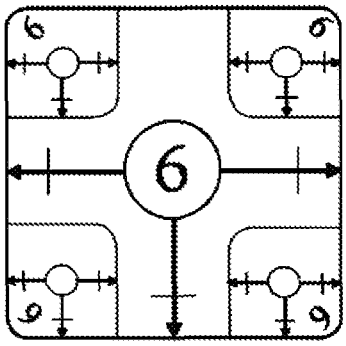
Figure 19:
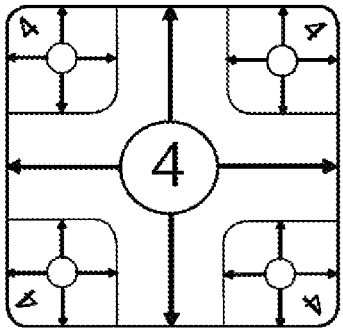
Figure 20:
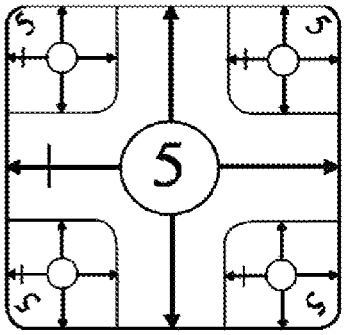
Figure 21:
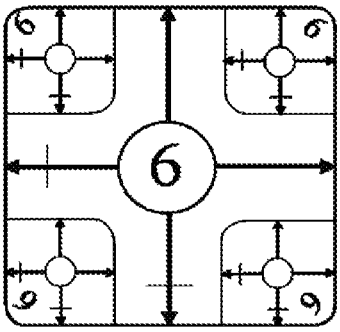
Figure 22:
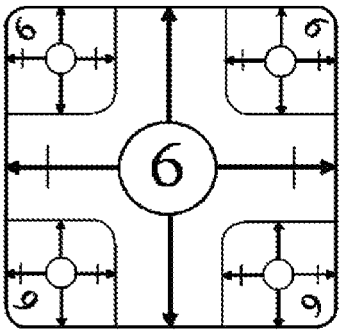
Figure 23:
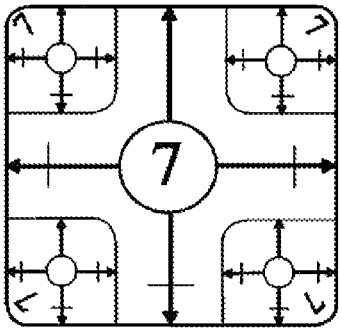
Figure 24:
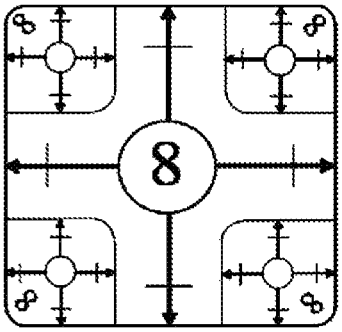

Referring simultaneously to FIGS. 1-24, it may be seen that each of the depicted frames includes a rotational objects array or rotational series of objects which differs from that of each other frame among such 24 frames. Beginning with the uppermost object shown upon each of the frame among the FIGS. 1-24 frames, and progressing about each of such frames in a clockwise zone-to-zone fashion, the rotational and cyclically repeating object type series supported by the Drawing FIGS. 1-24 frames are as set forth in the following table:

| | |
|---|---|
| FIG. 1 | first, first, first, first |
| FIG. 2 | first, first, first, second |
| FIG. 3 | first, first, first, third |
| FIG. 4 | first, first, second, second |
| FIG. 5 | first, first, second, third |
| FIG. 6 | first, first, third, second |
| FIG. 7 | first, first, third, third |
| FIG. 8 | first, second, first, second |
| FIG. 9 | first, second, first, third |
| FIG. 10 | first, second, second, second |
| FIG. 11 | first, second, second, third |
| FIG. 12 | first, second, third, second |
| FIG. 13 | first, second, third, third |
| FIG. 14 | first, third, first, third |
| FIG. 15 | first, third, second, second |
| FIG. 16 | first, third, second, third |
| FIG. 17 | first, third, third, second |
| FIG. 18 | first, third, third, third |
| FIG. 19 | second, second, second, second |
| FIG. 20 | second, second, second, third |
| FIG. 21 | second, second, third, third |
| FIG. 22 | second, third, second, third |
| FIG. 23 | second, third, third, third |
| FIG. 24 | third, third, third, third |

Where a value n equals a number of unique object types, and where renditions of those object types are supported and arranged in rotational series upon such frames (i.e., within such frames' quadruples of isosceles triangular zones), the number of unique frames which include such rotational object series is determined by the formula $(n^4+n^2+2n)/4$. Where n equals 3, indicating three distinct object types (e.g., a null space object type, a plain arrow ink deposition object type, and a notched arrow ink deposition object type), such formula produces the number 24. Hence, the 24 unique frames of the instant inventive frame set.

For purposes of accommodating a greater number of game playing contestants, the number of unique objects which are supported in four element rotational series upon the inventive frame set may be increased from 3 to 4. For example, a frame set supporting bead (e.g., bead 56 of FIG. 28), bead pair (e.g., bead 60 of FIG. 28), bead triple, and bead quadruple object types may be provided, resulting in an "n" value of four. Where n equals four, the $(n^4+n^2+2n)/4$ formula produces a set of 70 cards, each bearing a unique rotational series of such bead type objects. Where the inventive frame set includes 70 frames, each of the frames of the n=3 frame set (i.e., a set consisting of 24 frames) is included within or comprises a subset of the 70 frame set. To accommodate an even larger number of players, the value "n" may be increased to 5 (by adding, for example, a null object to the above described quadruple of bead object types), resulting in a 165 frame set.

Multiple functional relationships exist between the instant invention's frames and instant invention's objects. One notable functional relationship results or arises from close mechanical associations between the rotational character of the frames' physical features and the objects' four element rotational series. As indicated above, each frame's corner-to-corner diagonals define at the frame's upper side a set of four or quadruple of isosceles triangular quadrants. Beginning at any one of the frames' triangular quadrants, and progressing clockwise in a zone-to-zone fashion over the frame's upper end, one invariably rotationally cyclically returns to the beginning triangular quadrant. A progression in the same fashion over the frame in the counter-clockwise direction similarly rotationally returns to the beginning triangular quadrant. Like the four orthogonal edges, each frame's triangular quadrants constitute rotational four element series, the elements of each such series constituting a quadruple of physical zones or areas within or upon the frames.

Also as indicated above, for any set of objects drawn from three distinct object types, there are at most 24 unique four element rotational series of objects which can be created. A portion of the instant invention's functional frames/object series relationship arises from an identical matching of the number of the frames in the inventive frame set (i.e., 24) with the number of those unique rotational series of objects (i.e., 24). A further functional inter-relationship arises from the fact that the diagonals of the 24 frames cumulatively define 96 isosceles triangular quadrants, and from the fact that only 96 objects selected from a supply of three unique object types are needed to create all 24 of the invention's unique four element rotational series of objects. Those 96 selected objects are, in accordance with the instant invention, physically provided, and the 24 frames of the instant invention perform a function of mechanically positioning and fixedly holding each of those 96 objects within one of the frames' triangular quadrants. According to the invention, such mechanical support and positioning arranges the objects so that no two objects reside within any one of the 96 quadrants. A further frame/object series functional relationship arises from the fact that the frames fixedly position and mechanically arrange the invention's 24 four element rotational object series so that each series is physically supported and held upon one of the frames. According to the invention, such mechanical support positions and arranges the four element object series so that no two of such series is physically attached to any one frame. Each individual frame among the 24 frame set further functions in relation to one of the rotational object series by physically supporting each of such series' objects within one of such frame's triangular quadrants. Such physical support and positioning provided by each frame component to its four element rotational series of objects requires that the above described clockwise or counter-clockwise progression about the frame's four quadrants simultaneously progresses about or cycles through the attached four element rotational series of objects. Accordingly, the functionally inter-related structures of the instant invention require that a clockwise or counter-clockwise progression about a frame's four quadrants simultaneously progress about the attached four element rotational series of objects.

The functionality of the instant invention's frames in relation to their four element object series may also be understood by recognizing the fact that the invention's set of 24 substantially square frames constitutes a machine or tool which is specially adapted for arranging and supporting the instant invention's 24 four element rotational series of three objects in a manner which is consistent with or consonate with those series' cyclical nature. The inventive frame's tool function is demonstrated by hypothetically considering alternative tools comprising sets of triangular frames or sets of pentagonal frames. A set of 24 triangular frames could conceivably fixedly support and position the instant invention's 24 four element rotational series of objects. However, any arrangement of a four element series of objects upon a triangular frame would associate at least one pair of objects among the four objects more closely with one side of the triangle than with either of the other two sides of the triangle. Therefore, upon utilization of the hypothetical triangular frame tool, and upon a clockwise progression about such triangular frame, a single progression step about the frame would traverse a pair of elements among the four object rotational series. In each cyclical step or progression along one of the instant invention's four elements rotational series, only one element of the series may be met, not two. Therefore, such hypothetical triangular frame set could not support the invention's four element rotational series in a manner which is consistent with their cyclical character.

Upon a provision of an alternative hypothetical pentagonal frame tool, it would be mechanically impossible for any of the instant inventions' four element rotational series of objects to be properly supported and arranged. This is because it is mechanically impossible to support and associate four discreet objects with the five sides (or five surface zones) of a pentagonal frame. At least one frame side or zone would always remain unassociated with the four objects, effectively introducing into the object series a fifth null object. Such altered five element series would not constitute the instant invention's four element series, and no support of any four element series would be provided by such hypothetical pentagonal frame.

Consideration of the instant invention's actual four sided frame set tool of the instant invention, in view of the functional deficits of such hypothetical three sided and five sided frame set tools, shows that the instant invention's four sided frame tool set is the only tool set which is capable of functioning in the manner required by the instant invention.

Other geometrically shaped frame sets (such as circular frames and hexagonal frames), may be hypothetically considered in the manner described above, and all of such other alternative frame configurations would similarly be found to be incapable of arranging the invention's four element rotational series of three object types in a manner consistent with such series cyclical nature.

The functional relationship existing between the instant invention's frame set and the instant invention's four element rotational series is further demonstrated by the fact that both the frame set and the four element rotational series of objects are capable of being arranged on a flat surface in a square matrix pattern. The capacity of the invention's four element rotational series of objects to be arranged in a square matrix pattern is not dependent upon the square frames. Similarly, the capacity of the square frames to be arranged in a square matrix pattern is not dependent upon the invention's four element series of objects. However, a simultaneous arrangement of both the invention's object series and the invention's frames in a single square matrix pattern is dependent upon the frame's mechanical support and positioning of the object series. The instant invention requires such simultaneous square matrix creations, and the invention's frames and object series mechanically work together to perform that function.

Factors outlined and described above are considered as constituting grounds and reasons establishing that in the instant invention there is a functional relationship existing between the invention's four element rotational series of objects selected from three object types, and the instant invention's set of substantially square frames. Notwithstanding, the above recited factors are not considered as being the only grounds and reasons which establish the fact that such functional relationship exists.

The instant inventive frame set's utilization of the $(n^4+n^2+2n)/4$ formula prescribing the number of frames in the set, along with the instant invention's correlation of unique rotational series of objects within the frame set allows game playing contestants utilizing the inventive frame set to easily mentally conceptualize, understand, and memorize the various frames which are included within the inventive frame set. Accordingly, the inventive frame set facilitates game playing contestants' ability to deduce or infer probabilities relating to the identity of unviewed frames held by other game playing contestants or remaining in an undistributed portions of such set. Such frame identity deduction facilitation enhances the inventive frame set's ability to support strategic game play.

Referring simultaneously to FIGS. 1-27, in a preferred of mode play utilizing the inventive frame set, a plurality of game playing contestants, suitably as few as two contestants, may each be dealt a subset 30 of frames among the FIGS. 1-24 frames. Thereafter, a first contestant may play upon a flat play surface 32 such as a table top a first frame such as the FIG. 9 frame.

Figure 27:
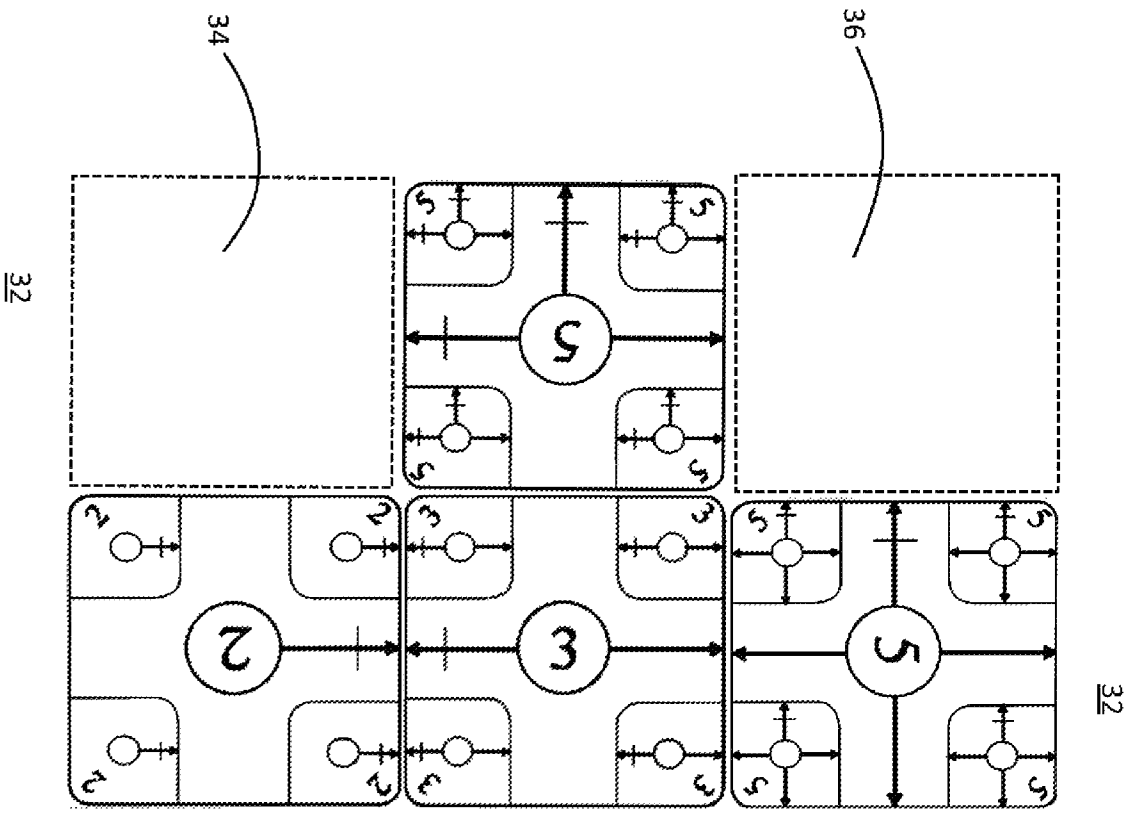
FIG. 27 presents a grouping of frames of FIGS. 20, 17, 9, and 3 placed and arranged during game play.

Thereafter, the second game playing contestant may play a next successive frame such as the FIG. 3 frame. As indicated in FIG. 27, the second game playing contestant opted to match the third object type (i.e., the notched arrow ink disposition) of the FIG. 3 frame with the FIG. 9 frame's third object type. In such successive frame play, the second contestant might have suitably alternatively matched any of the FIG. 3 frames' three first object types (i.e., its null objects) with either one of the FIG. 9 frame's first type objects.

Thereafter, in a next successive game play turn, the first game contestant may play the FIG. 20 frame as indicated with one of such frame's second objects matching the FIG. 9 frame's single second object.

Thereafter, the second game playing contestant may play in turn the FIG. 17 frame as indicated. According to the configurations of frames appearing upon the table 32 immediately prior to such successive play turn, the second game playing contestant would have had eight other ways to matchingly play the FIG. 17 frame, including a possible opposite side match of the FIG. 9 frame, three modes of matching the FIG. 3 frame, and four modes of matching the FIG. 20 frame.

Figure 26:
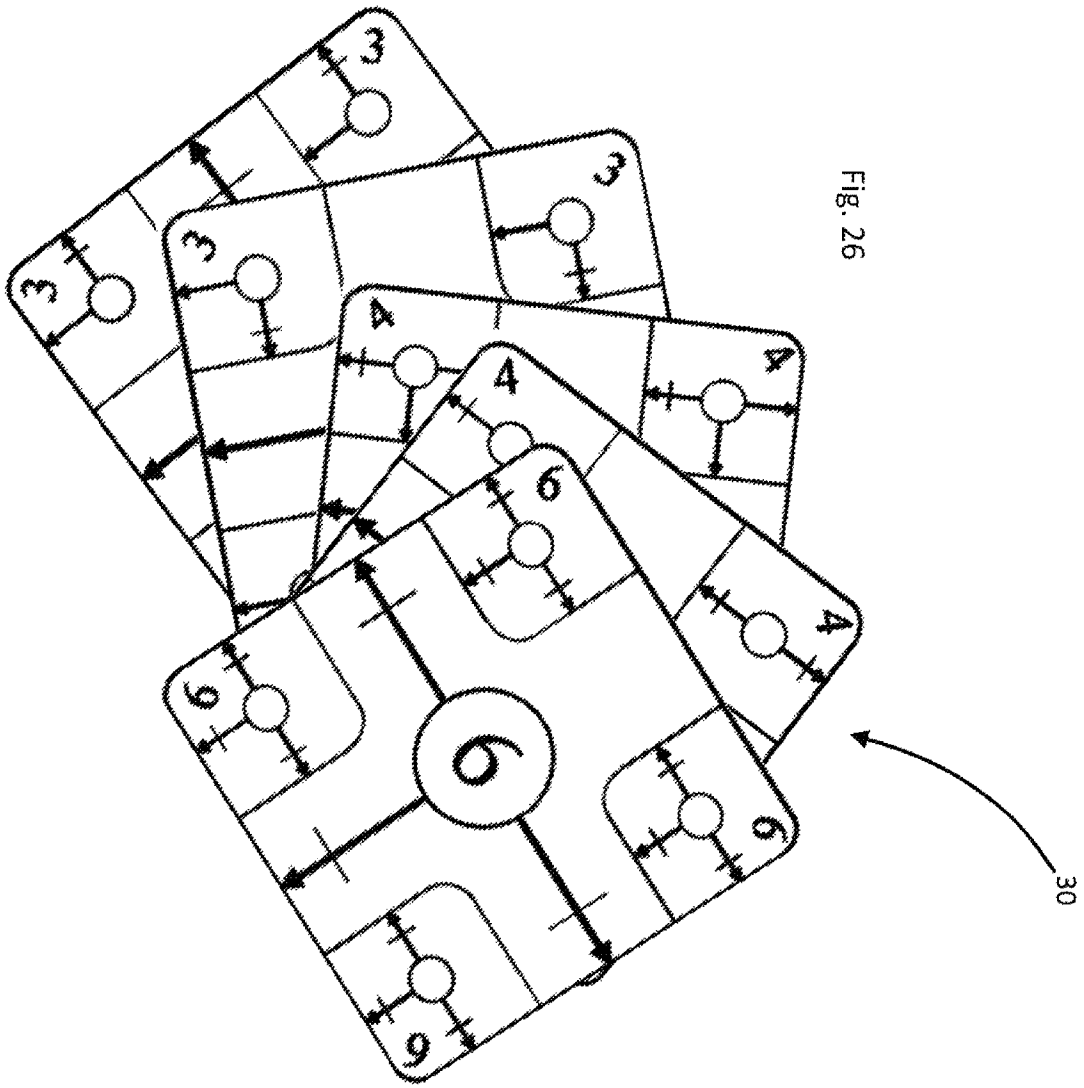
FIG. 26 presents a fanned configuration of the frames of FIGS. 5, 6, 11, 14, and 18.

Assuming that the first game playing contestant has in his or her frames the five frames indicated in Drawing FIG. 26 (i.e., the FIG. 5, FIG. 6, FIG. 11, FIG. 14, and FIG. 18 frames), he or she is able to play at the next play turn one of his or her frames upon the table 32 to complete a square matrix of frames in five separate and distinct ways. Any one of the first contestant's FIG. 5, FIG. 11, FIG. 14, and FIG. 18 frames may be played by the first contestant within space 34 to complete a four frame matrix which includes the FIG. 17, FIG. 9, and FIG. 3 frames. Alternatively, the first game contestant may play the FIG. 6 frame within space 36 to complete a different four frame matrix which includes the FIG. 20, FIG. 9, and FIG. 17 frames.

The instant inventive game establishes a game playing objective of completing one or more of such four frame matrixes. In pursuit of such objective, the first contestant may recognize upon said game turn that, upon playing the FIG. 6 frame within space 36, the only other frames among the 24 frame set which could be played within space 34 to complete a second four frame matrix are the FIG. 7, FIG. 13, and FIG. 16 frames. The first game playing contestant may choose as a matter of strategy to play the FIG. 6 frame within space 36 with such frame's third and second objects respectively matching those of the FIG. 20 and FIG. 17 frames. The strategy of such a frame play would rest upon a comparison of the probability that each of the FIGS. 7, 13, and 16 frames (i.e., the available frames that are playable within space 34) is undistributed rather than held by the second contestant, with the probability that each of the FIGS. 12, 15, 16, 21, 22, and 23 frames (i.e., the available frames that are playable within space 36) are undistributed. Provided that each frame among the FIG. 7, FIG. 13, and FIG. 16 frames has yet to be distributed to or drawn by the second game playing contestant, the first game playing contestant is assured that on his or her next play turn, one of the FIG. 5, FIG. 11, FIG. 14, or FIG. 18 frames will be playable within space 34, resulting in a second completion by the first contestant of a square frame matrix. The probability of completing a second square matrix at space 34 may be seen by the first contestant as inherently greater than the probability of completing a second square matrix at space 36.

The first game playing contestant's knowledge of the identity of the frames among the 24 frame deck, along with his or her views of the frames held personally, and views of frames played upon the table, advantageously allows the first contestant to assess such probabilities and to strategically perceive the greater likelihood that the second game playing contestant holds a frame playable within space 36. Thus, the next frame play executed by the first contestant may advisedly constitute a placement of the FIG. 6 frame within space 36.

Strategic choices, inferences, and deductions of the type described above continuously arise as the game play progresses, and the unique configuration of the frame's rotational series of objects continuously facilitates the making of such strategic choices.

In the preferred mode of play of the instant inventive card game, points are awarded to each game playing contestant who completes a square frame matrix. Integer indicia appearing upon the frames of completed square matrixes may be a factor in points awards, such factor advantageously enhancing the game's capacity for strategic play.

At a termination of play, the game playing contestant having the most cumulative awarded points is declared to be the winner.

Portions of the disclosure set forth above state and describe the invention's functional objective of allowing the game playing contestants to mentally conceptualize, understand, and memorize the members of the invention's set of 24 frames. For example, the first sentence of the third paragraph of the above "Background of the Invention" section of this disclosure states:

"The instant invention's utilization of the $(n^4+n^2+2n)/4$ rotational object series defining formula advantageously allows game contestants utilizing the inventive frame and playing the inventive game based thereon to memorize and/or conceptually understand the identity of each of the frames among the set."

Also, the third and fourth sentences of the eleventh paragraph of the above "Brief Summary of the Invention" section of this disclosure, state:

"The contestants' ability to make such deductions and inferences is facilitated by the frame set's $(n^4+n^2+2n)/4$ formula based rotational series of unique objects, such formula enhancing the contestants' conceptual understanding of the frames' individual configurations. Such conceptual understanding assists in the making of strategic choices during game play."

As a further example, the first sentence of the $24^{th}$ paragraph of the instant "Detailed Description of Preferred Embodiments and of a Preferred Mode of Game Play" section of this disclosure states:

"The instant inventive frame set's utilization of the $(n^4+n^2+2n)/4$ formula prescribing the number of frames in the set, along with the instant invention's correlation of unique rotational series of objects within the frame set allows game playing contestants utilizing the inventive frame set to easily mentally conceptualize, understand, and memorize the various frames which are included within the inventive frame set."

In order to demonstrate the fact that the instant invention's set of 24 square frames performs the above described conceptualization, understanding, and memorization facilitation functions, text based descriptions also appear above of hypothetical alternative triangular frame components (See above, at the third sentence of the $18^{th}$ paragraph of the "Detailed Description of Preferred Embodiments and of a Preferred Mode of Game Play" section of this disclosure), and of hypothetical alternative pentagonal frame components (See above at the first sentence of the $19^{th}$ paragraph of the "Detailed Description of Preferred Embodiments and of a Preferred Mode of Game Play" section of this disclosure). Such hypothetical alternative triangular frames are drawn in Drawing FIGS. 38-61, and such hypothetical alternative pentagonal frames are drawn in Drawing FIGS. 62-85. The instant invention's 24 four element rotational series of three distinct objects [e.g., a null (or blank) object, an arrow object, and a notched arrow object] which are supported, arranged, and displayed upon the 24 square frames of FIGS. 1-24 are shown as being hypothetically and alternatively supported, arranged, and displayed by the hypothetical triangular frames (FIGS. 38-61), and further hypothetically and alternatively by the hypothetical pentagonal frames (FIGS. 62-85).

This disclosure's presentation of the hypothetical sets of triangular frames and pentagonal frames is useful in achieving a correct understanding of the invention's actual set of 24 square frames because the functionality of such alternative hypothetical frames may be compared on a one-to-one basis with the functionality of the actual square frames.

Figure 38:
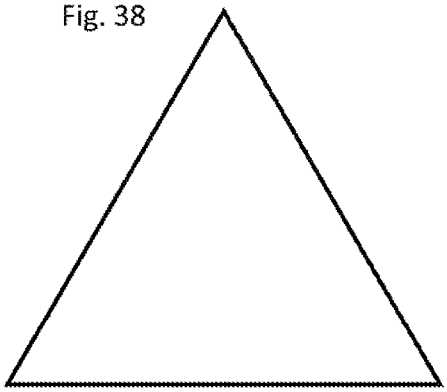
FIGS. 38-61 present alternatively configured triangular frames.
Figure 39:
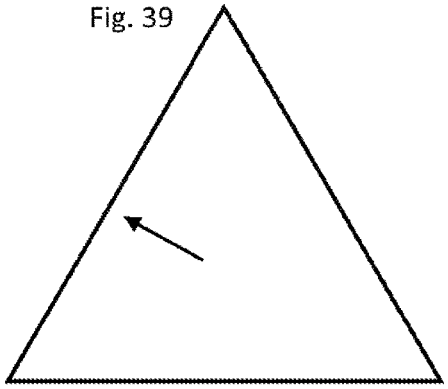
Figure 40:
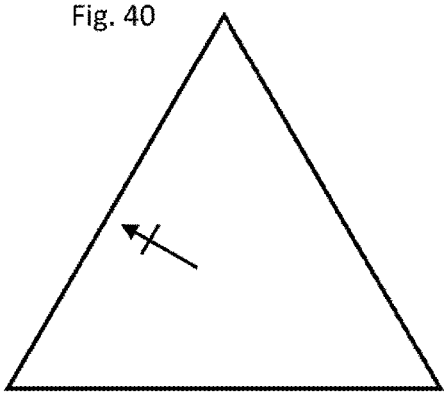
Figure 41:
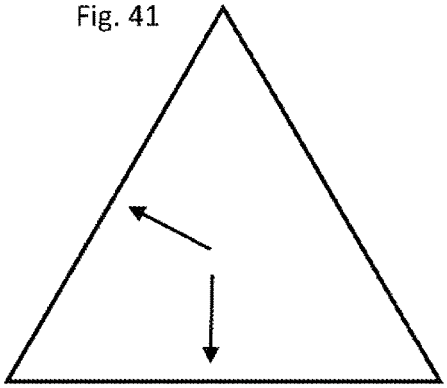
Figure 42:
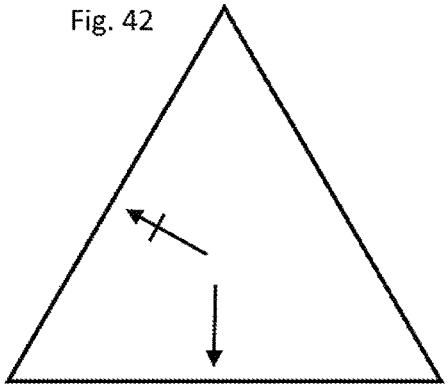
Figure 43:
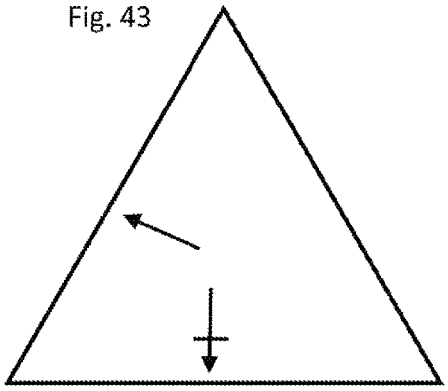
Figure 44:
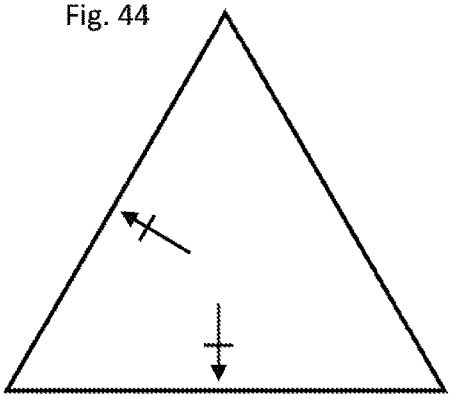
Figure 45:
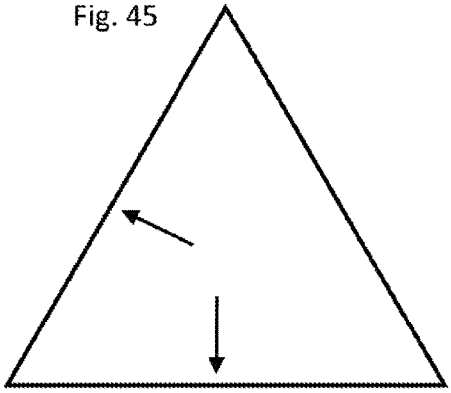
Figure 46:
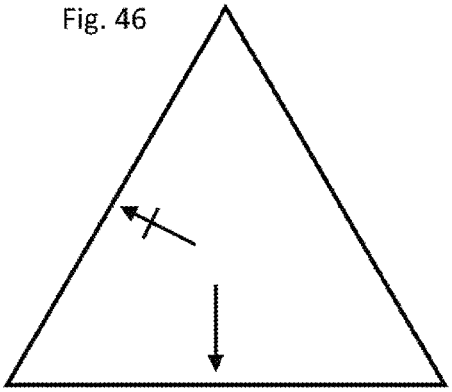
Figure 47:
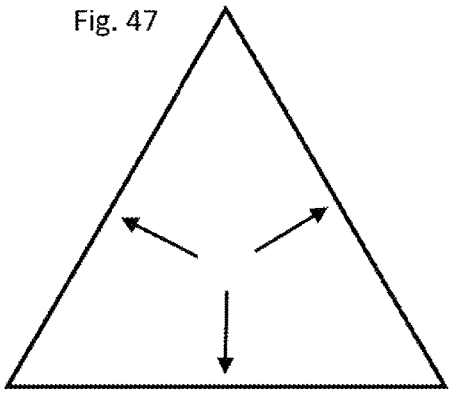
Figure 48:
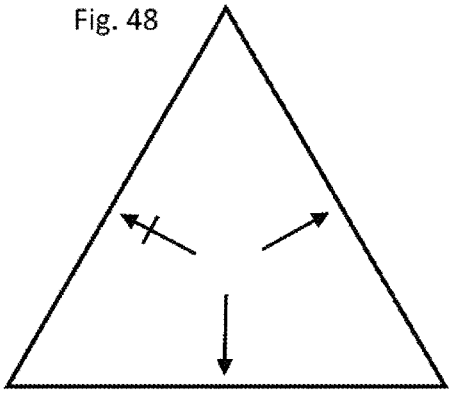
Figure 49:
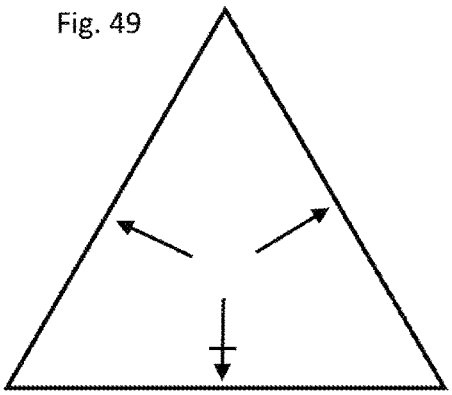
Figure 50:
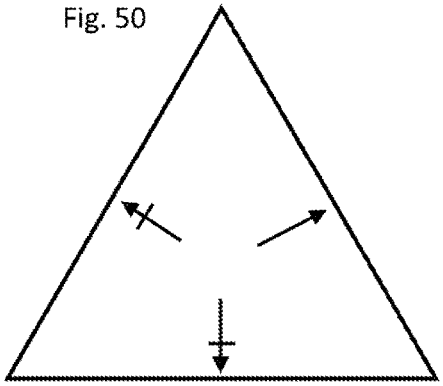
Figure 51:
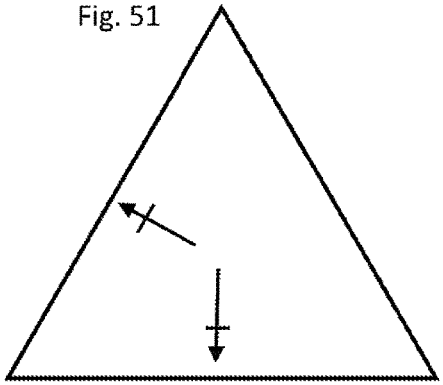
Figure 52:
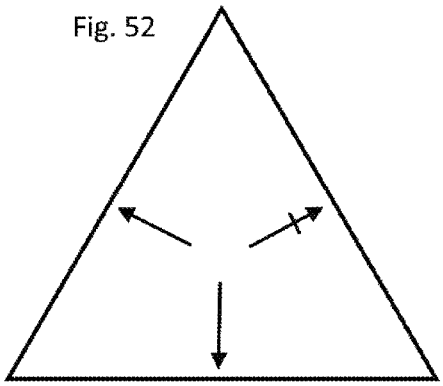
Figure 53:
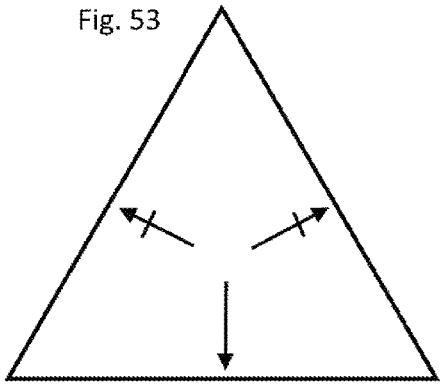
Figure 54:
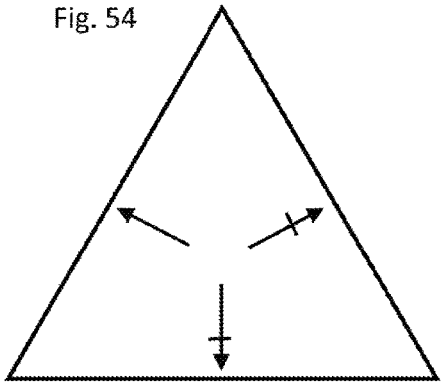
Figure 55:
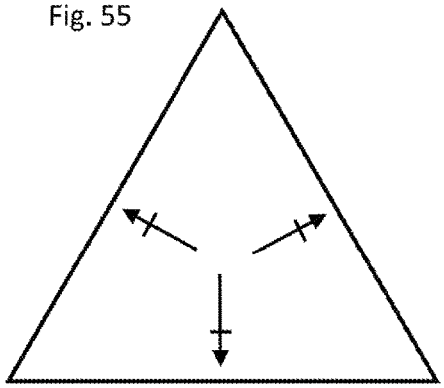
Figure 56:
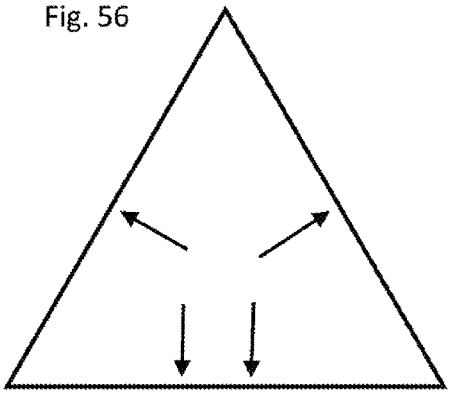
Figure 57:
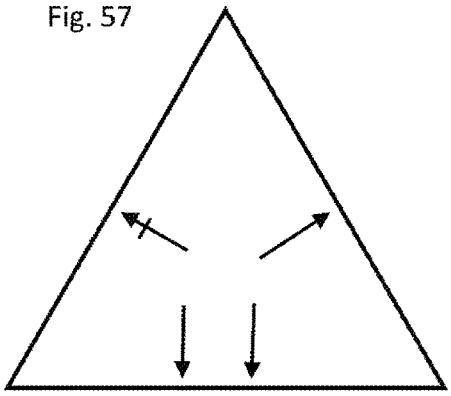
Figure 58:
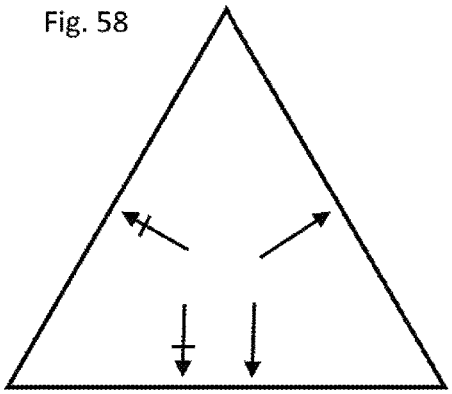
Figure 59:
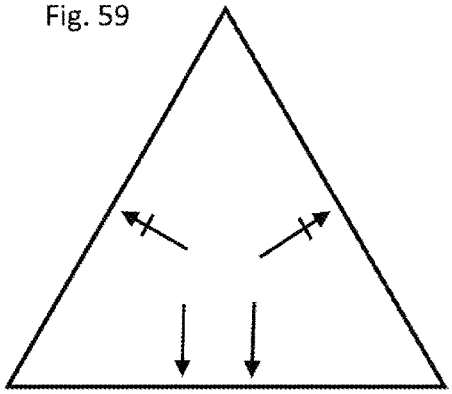
Figure 60:
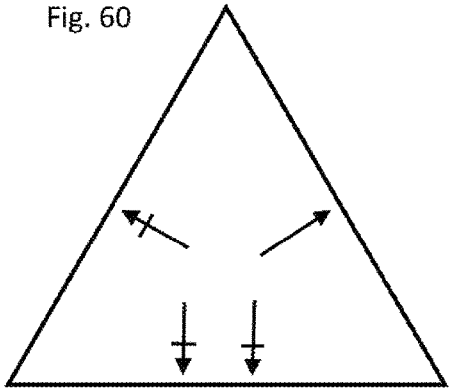
Figure 61:
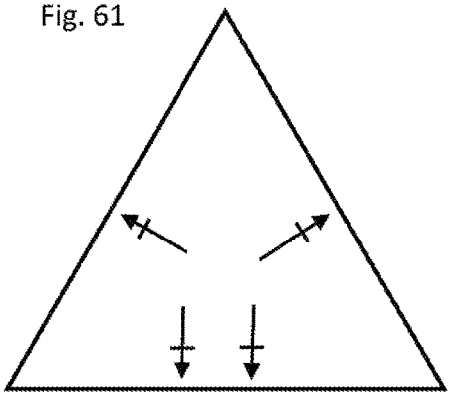

Such beneficial one-to-one comparison of the functionality of the instant invention's 24 square frames with that of the 24 alternative hypothetical triangular frames entails a matching of the square frame of FIG. 1 with the triangular frame of FIG. 38, of FIG. 2's frame with FIG. 39's frame, of FIG. 3's with FIG. 40's, of FIG. 4's with FIG. 41's, . . . and of FIG. 24's with FIG. 61's. The initial comparison of the square FIG. 1 frame with the triangular FIG. 38 frame shows that the invention's unique "null,null,null,null" four element rotational series of objects which is supported, arranged, and displayed by the square FIG. 1 frame may be considered as being alternatively supported, arranged, and displayed by the triangular FIG. 38 frame. The viewer of the FIG. 1 frame can readily see that no arrow of any type is associated with any of the frame's four sides, and the viewer can easily perceive and correctly conclude that FIG. 1's frame supports and displays the "null,null,null,null" member of the invention's set of 24 unique four element rotational series of the three things. In contrast, the same viewer who alternatively views the hypothetical FIG. 38 frame could not easily perceive or conclude that the alternative triangular frame supports, arranges, and displays that same "null,null, null,null" rotational series. This is because the triangular frame has only three sides, leading the viewer to naturally (and erroneously) conclude that the FIG. 38 frame supports, arranges, and displays a three element "null,null,null" rotational series.

While each of the blank sides of FIG. 38's three sided triangular frame is capable of supporting and displaying two "null" objects, the triangular character of such frame does not functionally assist the viewer in perceiving and correctly concluding that any of the sides displays more than a single null object. Instead of lending any such assistance to the viewer, the three sided character of the FIG. 38 frame would actively promote and cause the viewer to make an erroneous conclusion that each of the frame's blank sides supports and displays one and only one null object.

Where one of the three sides of the FIG. 38 triangular frame in fact supports and displays two null objects (as must be the case in the event that one were to attempt to cause the FIG. 38 frame to support, arrange, and display FIG. 1's four null objects), such fact is actively hidden and obscured by the three sided character of the FIG. 38 frame. Accordingly, where a triangular frame such as the frame of FIG. 38 supports and displays the instant invention's "null,null,null, null" four element rotational series, such frame will, in a harmful way, cause the viewer to erroneously conclude that a wholly different rotational series (i.e., a "null,null,null" rotational series) is supported and displayed. Such error would constitute a serious error since the instant invention's set of 24 unique four element rotational series of three objects does not include any "null,null,null" rotational series.

In contrast with the instant invention's FIG. 1 square frame (which functions to promote conceptualization, understanding, and memorization of one of the members of the instant invention's discreet set of 24 four element rotational series of objects), a support by the alternative triangular frame of FIG. 38 of the same four element "null,null,null,null" series would undesirably degrade the viewer's ability to conceptualize, understand, and memorize by actively causing the viewer to erroneously perceive a "null,null,null" rotational series which does not constitute a member of the set of 24 distinct four element rotational series. Such undesirable and negative function which would be performed by the hypothetical alternative triangular FIG. 38 may be recognized as a factor indicating that the instant invention's provision of a side upon the FIG. 1 frame in addition to such frame's first, second, and third sides is crucial and outcome determinative in relation to the instant invention's performance of its functional objectives.

Figure 62:
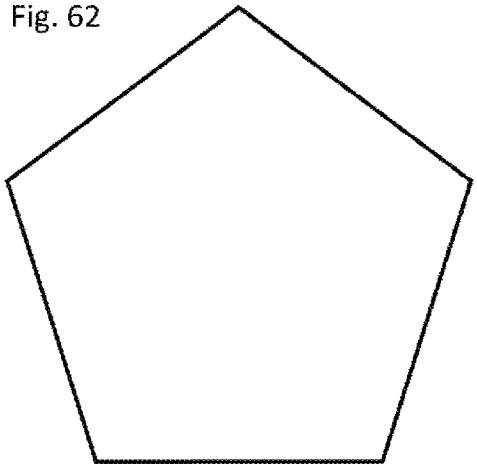
FIGS. 62-85 present alternatively configured pentagonal frames.
Figure 63:
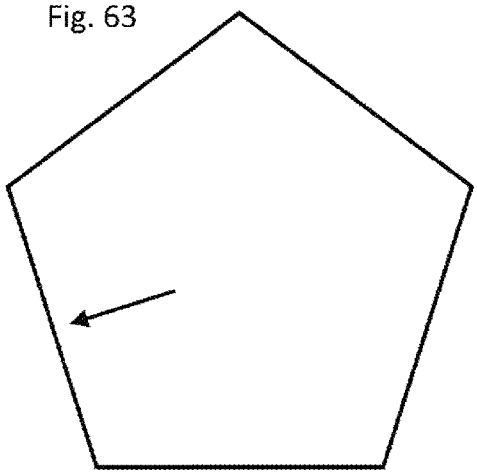
Figure 64:
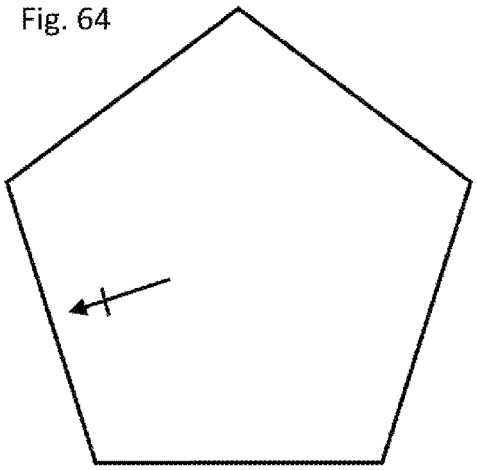
Figure 65:
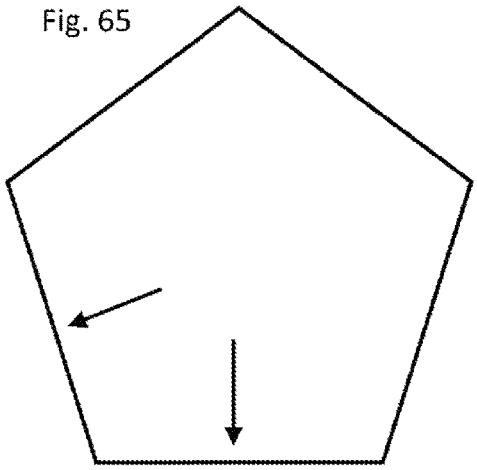
Figure 66:
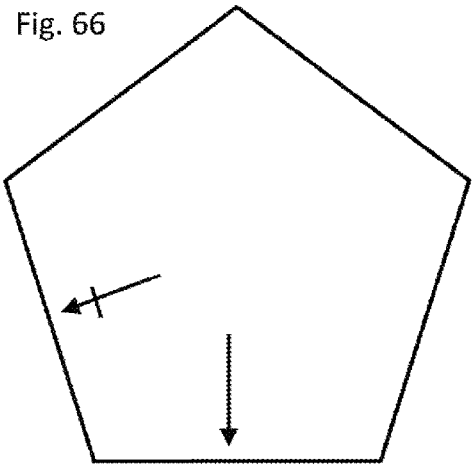
Figure 67:
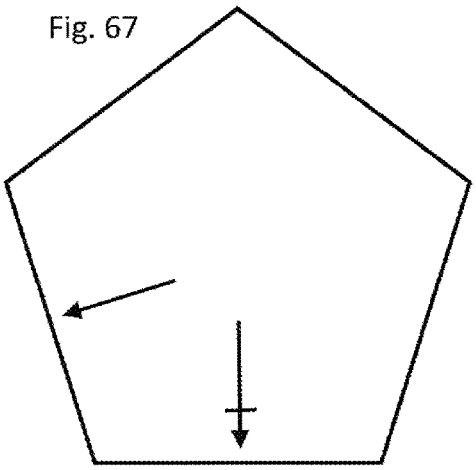
Figure 68:
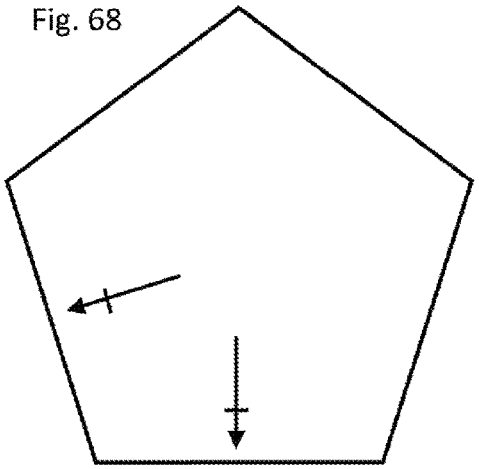
Figure 69:
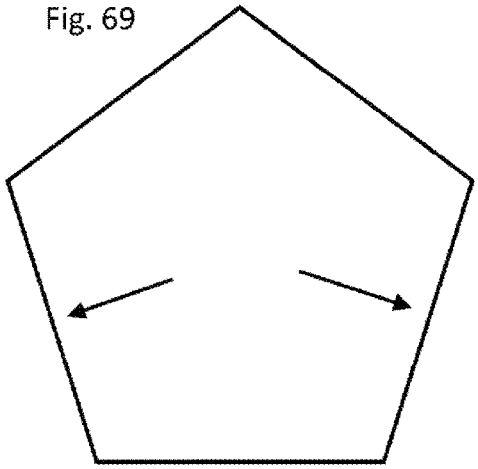
Figure 70:
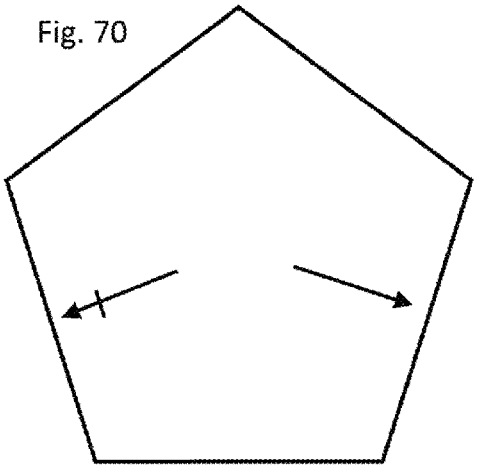
Figure 71:
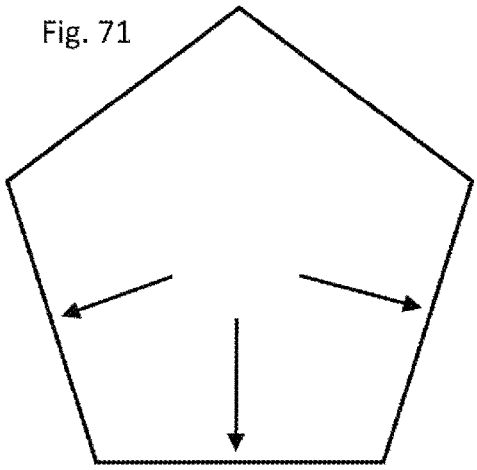
Figure 72:
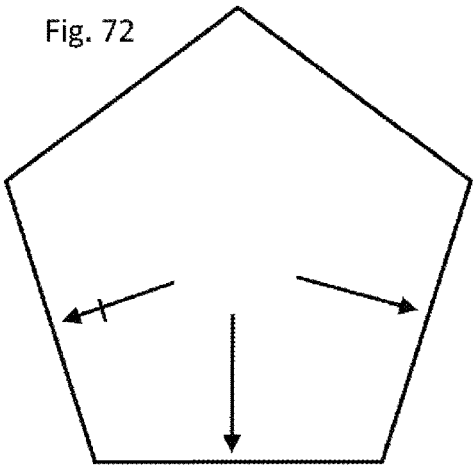
Figure 73:
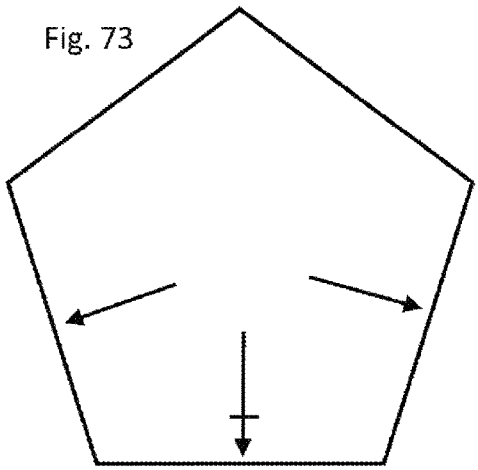
Figure 74:
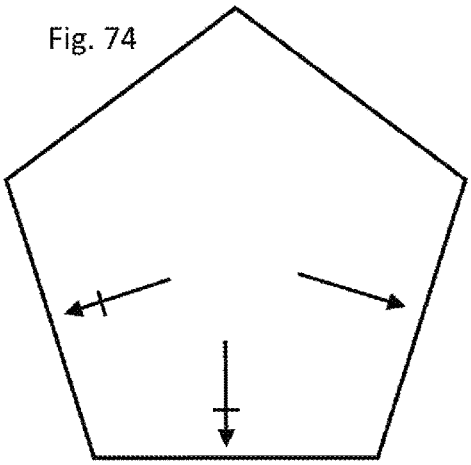
Figure 75:
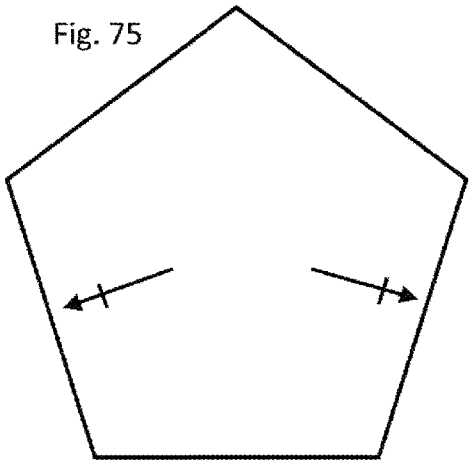
Figure 76:
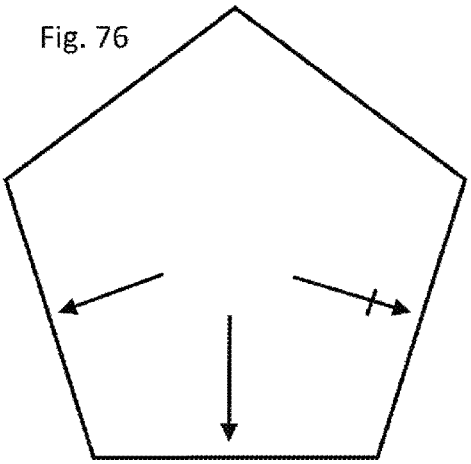
Figure 77:
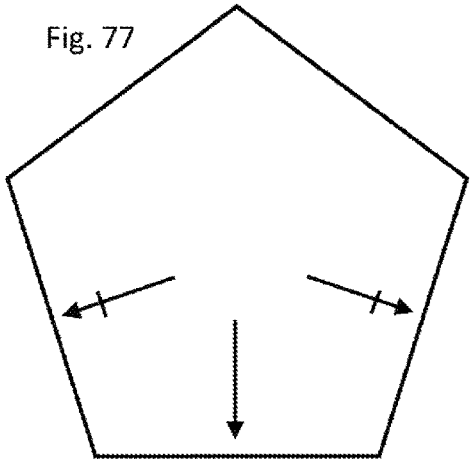
Figure 78:
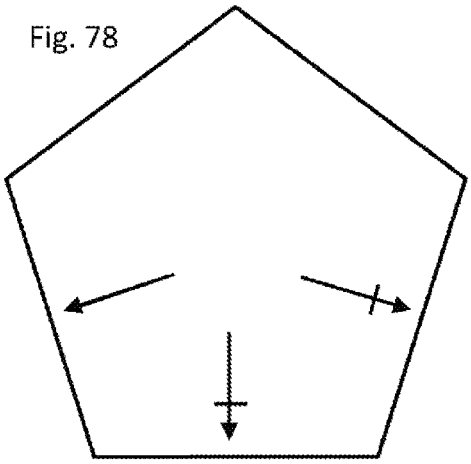
Figure 79:
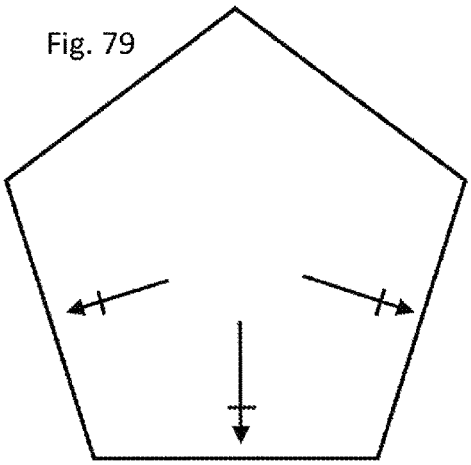
Figure 80:
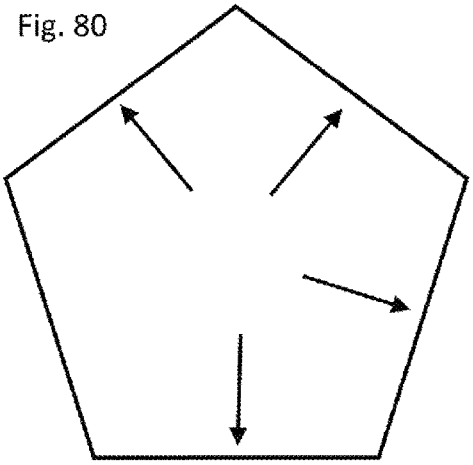
Figure 81:
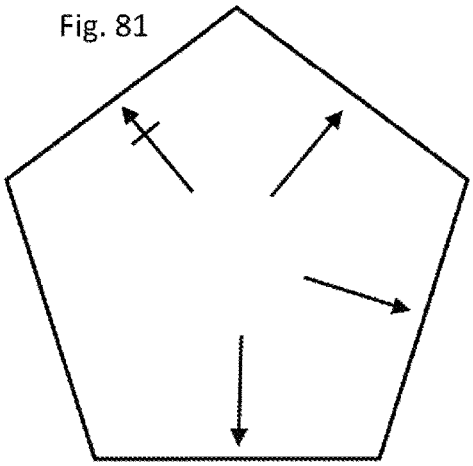
Figure 82:
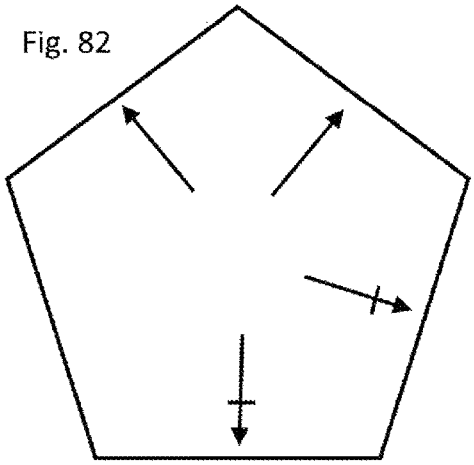
Figure 83:
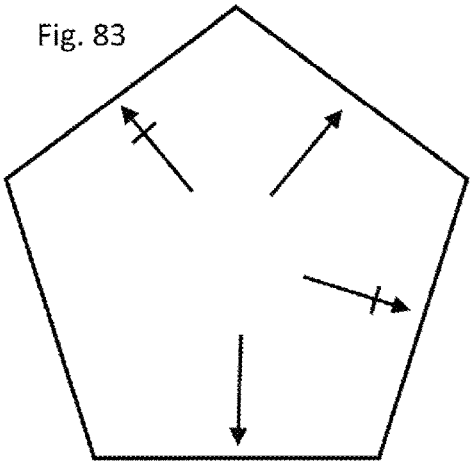
Figure 84:
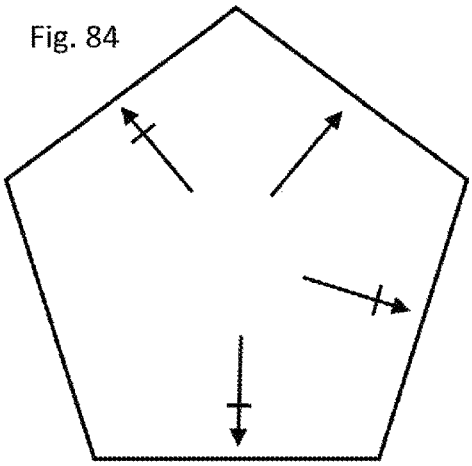

The above functional comparison of the square FIG. 1 square frame with the hypothetical triangular FIG. 38 frame may be alternatively made in a similar fashion with FIG. 62's pentagonal frame. Similarly with the triangular FIG. 38 frame's hypothetical support of the "null,null,null,null" rotational series, FIG. 62's pentagonal frame may be viewed as alternatively supporting the same "null,null,null,null" rotational series of objects. However, similarly with the above described disadvantages and negative functions of the FIG. 38 triangular frame, the hypothetical alternative FIG. 62 pentagonal frame would lend no assistance to the viewer in conceptualizing, understanding, and memorizing "null,null, null,null" frame member. Instead of lending such assistance, the FIG. 62 pentagonal frame would operate to cause the viewer to conclude that each of the frame's five blank sides supports and displays a null object. Instead of beneficially promoting the viewer's recognition and understanding of the instant invention's unique "null,null,null,null" four element rotational series of objects, the hypothetical pentagonal frame of FIG. 62 would harmfully cause the viewer to recognize and conceptualize a "null,null,null,null,null" rotational object series, which is not a member of the invention's set of 24 unique four element rotational series of objects. Just as the triangular FIG. 38 frame would degrade and detract from the performance of the instant invention's conceptualization, understanding, and memorization functions, the alternative hypothetical pentagonal frame of FIG. 62 would degrade and detract from the performance of that function.

Figure 85:
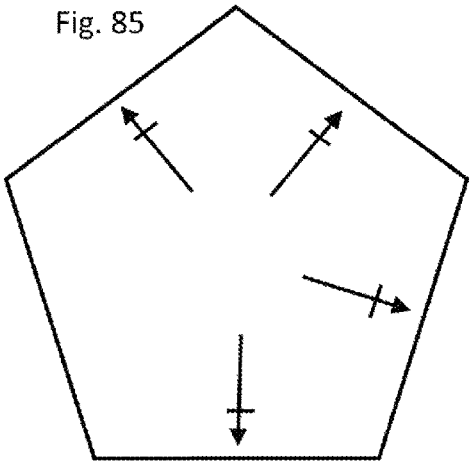

The instant invention's actual square FIG. 24 frame, which supports, arranges, and displays the instant invention's notched arrow quadruple rotational series of objects may be similarly compared with the corresponding hypothetical alternative triangular and pentagonal frames of FIGS. 61 and 85. Since the FIG. 24 frame is square and has four sides, such frame supports, arranges, and displays the invention's four notched arrows rotational series in a manner which aids and assists the viewer in conceptualizing, understanding, and memorizing the fact that such rotational series constitutes one of the invention's 24 distinct four element rotational series of objects. In contrast, the triangular character of the FIG. 61 frame would necessarily cause the viewer to erroneously perceive a twin notched arrow object which is not one of the instant invention's three distinct object types. Alternatively, three notched arrows could be placed at one of the triangle's sides with one notched arrow at another side and a blank space at the remaining side. Or, further alternatively, four notched arrows could be placed at one of the triangle's sides, leaving the other two blank. Both of such alternatives would deviate from the performance of the invention's functions more severely than the arrangement of the FIG. 61 frame.

In further contrast with the FIG. 24 frames, the FIG. 85 pentagonal frame necessarily includes at least one blank side, causing the viewer to erroneously perceive a five element "notched arrow, notched arrow, notched arrow, notched arrow, null object" rotational series which is not a member of the invention's set of 24 distinct four element series.

Where the triangular and pentagonal frames of FIGS. 61 and 85 are alternatively and hypothetically utilized for supporting, arranging, and displaying the instant invention's four element "notched arrow, notched arrow, notched arrow, notched arrow" rotational object series, such alternative frames would actively degrade and prevent the instant invention's performance of the conceptualization, understanding, and memorization functions. Such negative and undesirable functions which would be performed by the alternatively configured frames of FIGS. 61 and 85 are additional factors establishing that the invention's actual four sided FIG. 24 frame performs functions of promoting viewer conceptualization, understanding, and memorization of the invention's unique "notched arrow, notched arrow, notched arrow, notched arrow" four element rotational series of objects.

The instant invention's remaining 22 square frames (i.e., the frames of FIGS. 2-23) may be similarly compared on a one-to-one basis with the 22 hypothetical triangular frames of FIGS. 39-60, and compared with the 22 hypothetical pentagonal frames of FIGS. 62-84. Each square frame among FIGS. 2-23 positively functions by assisting the viewer in conceptualizing, understanding, and memorizing the invention's unique and distinct set of 24 four element rotational series of objects. In contrast, each frame among the triangular FIGS. 39-60 frames, and each frame among the pentagonal FIGS. 62-84 frames would perform negative functions which would actively interfere with and frustrate the achievement of the invention's functional objectives.

The above comparisons of the instant invention's four sided square frames with the hypothetical alternative three sided triangular frames and five sided pentagonal frames show that the invention's four sided frames perform functions of promoting the invention's conceptualization, understanding, and memorization objectives in at least two ways. First, the invention promotes the conceptualization, understanding, and memorization by causing each frame to provide a side in addition to its first, second, and third sides. The invention's provision of a fourth side upon each of its 24 frames actively avoids all of the above described negative results which would be produced in the event that the frames' sides were limited to three (e.g., causing the viewer to perceive a rotational series of objects which is not a member of the instant invention's set of 24 four element rotational series, or causing the viewer to perceive an object type which is not one of the three distinct object types, or both). Second, the invention's frames promote achievement of the invention's objectives by eliminating each frame side in excess of four. Such frame side eliminating feature similarly actively avoids the above discussed negative results which would occur upon the frame's provisions of sides in excess of four (e.g., pentagonal, hexagonal, etc.).

The instant invention's square frames which necessarily include more than three sides and which necessarily include fewer than five sides have structural and mechanical abilities to perform the invention's functions. In contrast, the alternative hypothetical frames whose provisions of sides do not satisfy the four sided criteria are rendered mechanically incapable of performing or achieving the invention's objectives.

The functional capacity of the instant invention's 24 square frames to perform and achieve the instant invention's objectives is demonstrated by the performance failures which would result upon altering those frames to include either a lesser number of sides or a greater number of sides.

While the principles of the invention have been made clear in the above illustrative embodiment, those skilled in the art may make modifications in the structure, arrangement, portions, and components of the inventive card deck, and those skilled in the art may make modifications to the method steps including their identity, character, and sequence of performance without departing from the principles of the invention. Accordingly, it is intended that the description and drawings be interpreted as illustrative and not in the limiting sense, and that the invention be given a scope at least commensurate with the appended claims.

The invention hereby claimed is:

1. A method for determining a winner among a plurality of game contestants, said method comprising steps of: (a)

providing a game play assembly consisting of: (i) 24 substantially square frames, each such frame having a quadruple of zones; and (ii) 96 objects, a first third of said 96 objects being of a first type, a second third of said 96 objects being of a second type, and the remainder of said 96 objects being of a third type, wherein the objects among the first third of said 96 are objects are substantially identical to each other, wherein the objects among the second third of said 96 objects are substantially identical to each other, and wherein the objects among the remainder of said 96 objects are substantially identical to each other, wherein said 96 objects are divided into 24 four element rotational series of objects, wherein each of said series is supported within one of the quadruples of zones, and wherein said each series is different from each of the 23 other series; (b) successive playing by the game contestants, said successive play comprising placements of said square frames upon a play surface, and comprising arrangements of said square frames wherein at least one object of each successively played square frame abuts at least one matching object of a previously played square frame; (c) awarding points to each game contestant who, upon one of said each contestant's plays, completes a square matrix of square frames; and (d) declaring one of the game contestants the winner, said one of the contestants being a contestant having a highest cumulative amount of awarded points.

* * * * *